US010762851B2

(12) United States Patent
Kwon et al.

(10) Patent No.: US 10,762,851 B2
(45) Date of Patent: Sep. 1, 2020

(54) TIMING CONTROLLER AND DISPLAY DEVICE INCLUDING THE SAME

(71) Applicant: Samsung Display Co., Ltd., Yongin-si, Gyeonggi-do (KR)

(72) Inventors: Tae Hoon Kwon, Yongin-si (KR); Ji Hyun Ka, Yongin-si (KR); Jae Sic Lee, Yongin-si (KR); Seung Ji Cha, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 43 days.

(21) Appl. No.: 16/109,320

(22) Filed: Aug. 22, 2018

(65) Prior Publication Data

US 2019/0096331 A1 Mar. 28, 2019

(30) Foreign Application Priority Data

Sep. 22, 2017 (KR) ..... 10-2017-0122549

(51) Int. Cl.
*G09G 5/10* (2006.01)
*G09G 3/3266* (2016.01)
(Continued)

(52) U.S. Cl.
CPC ..... *G09G 3/3266* (2013.01); *G09G 3/2096* (2013.01); *G09G 3/3233* (2013.01); *G09G 3/3275* (2013.01); *G09G 2300/0417* (2013.01); *G09G 2300/0819* (2013.01); *G09G 2300/0842* (2013.01); *G09G 2300/0861* (2013.01); *G09G 2310/0202* (2013.01); *G09G 2310/0286* (2013.01); *G09G 2310/067* (2013.01); *G09G 2310/08* (2013.01); *G09G 2320/0223* (2013.01); *G09G 2320/0233* (2013.01);
(Continued)

(58) Field of Classification Search
None
See application file for complete search history.

(56) References Cited

U.S. PATENT DOCUMENTS 9,330,601 B2 5/2016 Lee et al.
2006/0071888 A1 4/2006 Lee et al.
(Continued)

FOREIGN PATENT DOCUMENTS

KR 20080055133 A * 6/2008
KR 10-2015-0076868 A 7/2015

OTHER PUBLICATIONS

Extended European Search Report for corresponding European Patent Application No. 18196019.6, dated Jan. 31, 2019, 9 pages.

*Primary Examiner* — Lunyi Lao
*Assistant Examiner* — Kirk W Hermann
(74) *Attorney, Agent, or Firm* — Lewis Roca Rothgerber Christie LLP

(57) ABSTRACT

A display device includes: a display panel including a plurality of pixels; a scan driver configured to supply a scan signal to the plurality of pixels through a plurality of scan lines based on a scan start signal; an emission driver configured to supply an emission control signal to the plurality of pixels through a plurality of emission control lines based on an emission control start signal; and a timing controller configure to control an interval between a plurality of gate-on periods of the scan start signal within a gate-off period of the emission control start signal based on a dimming level.

30 Claims, 18 Drawing Sheets

(51) Int. Cl.
*G09G 3/3233* (2016.01)
*G09G 3/20* (2006.01)
*G09G 3/3275* (2016.01)

(52) U.S. Cl.
CPC ..... *G09G 2320/0242* (2013.01); *G09G 2320/0257* (2013.01); *G09G 2320/043* (2013.01); *G09G 2320/064* (2013.01)

(56) References Cited

U.S. PATENT DOCUMENTS

| | | | | |
|---|---|---|---|---|
| 2006/0248421 | A1 | 11/2006 | Choi | |
| 2008/0186260 | A1* | 8/2008 | Lee | G09G 3/3225 345/77 |
| 2009/0219236 | A1* | 9/2009 | Lee | G09G 3/3208 345/82 |
| 2011/0057917 | A1* | 3/2011 | Ryu | G09G 3/3233 345/211 |
| 2011/0115835 | A1* | 5/2011 | Lee | G09G 3/3233 345/691 |
| 2011/0193855 | A1 | 8/2011 | Han | |
| 2011/0273408 | A1* | 11/2011 | Ra | G09G 3/3266 345/204 |
| 2014/0092145 | A1* | 4/2014 | Park | G09G 5/00 345/690 |
| 2015/0109270 | A1* | 4/2015 | Ito | G09G 3/3677 345/207 |

* cited by examiner

TIMING CONTROLLER AND DISPLAY DEVICE INCLUDING THE SAME

CROSS-REFERENCE TO RELATED APPLICATION

The present application claims priority to and the benefit of Korean Patent Application No. 10-2017-0122549 filed in the Korean Intellectual Property Office on Sep. 22, 2017, the entire content of which is incorporated herein by reference.

BACKGROUND

1. Field

Aspects of some example embodiments of the present invention relate to a timing controller and a display device including the same.

2. Description of the Related Art

A display device may be embodied as an organic light emitting diode display including pixels formed by organic light emitting diodes. In general, an organic light emitting diode outputting green light has a higher luminous efficiency than an organic light emitting diode outputting red light or blue light, so that a sufficient luminance can be obtained even at a small current. Therefore, a driving current of the organic light emitting diode outputting green light may be smaller than that of the organic light emitting diode outputting red light or blue light, and a parasitic capacitance of the organic light emitting diode outputting green light and connected in parallel structurally may be larger than that of the organic light emitting diode outputting red light or blue light.

In the case where the organic light emitting diode display displays black and then displays white, although a current flowing through the organic light emitting diode outputting green light is smaller than a current flowing through the organic light emitting diode outputting red light or blue light, a charge amount for causing a voltage difference at both ends of the organic light emitting diode outputting green light to be equal to or higher than a threshold voltage is larger than a charge amount at both ends of the organic light emitting diode outputting red light or blue light. Therefore, the organic light emitting diode outputting green light may have a larger emission delay than the organic light emitting diode outputting red light or blue light, so that a color drag phenomenon in which the white displayed by the display device appears to have a purple color may occur.

Meanwhile, a driving transistor included in a pixel has a hysteresis characteristic in which a threshold voltage and a current of the driving transistor change based on a change of a gate voltage. Due to the hysteresis characteristic of the driving transistor, a current different from the current set in the pixel flows according to the previous luminance of the pixel. Therefore, the luminance of the pixel may not reach a target luminance (or a target grayscale level).

For example, display defects such as the emission delay of the pixel including the organic light emitting diode outputting green light and the color drag and an afterimage due to the hysteresis of the driving transistor may be easily observed by a user at low-luminance emission of the display device and cause inconvenience in viewing the display device.

The above information disclosed in this Background section is only for enhancement of understanding of the background and therefore it may contain information that does not constitute prior art.

SUMMARY

Aspects of some example embodiments of the present invention relate to a timing controller and a display device including the same. Some example embodiments relate to a timing controller and a display device including the same for improving display quality.

Some example embodiments may be related to a display device that controls an interval between gate-on periods of a scan start signal based on a dimming level.

Some example embodiments may be related to a display device that controls a width of a gate-on period of a scan start signal based on a dimming level.

Some example embodiments may be related to a timing controller included in the display device.

It should be understood, however, that aspects of the present invention are not limited to the aspects described above, and various changes and modifications may be made without departing from the spirit and scope of the invention.

According to some example embodiments of the present invention, a display device includes: a display panel including a plurality of pixels; a scan driver configured to supply a scan signal to the plurality of pixels through a plurality of scan lines based on a scan start signal; an emission driver configured to supply an emission control signal to the plurality of pixels through a plurality of emission control lines based on an emission control start signal; and a timing controller configure to control an interval between a plurality of gate-on periods of the scan start signal within a gate-off period of the emission control start signal based on a dimming level.

According to some embodiments, the gate-on periods include a first gate-on period and a second gate-on period, and the interval between the first gate-on period and the second gate-on period is a first interval when the dimming level corresponds to a predetermined reference dimming level.

According to some embodiments, the interval between the first gate-on period and the second gate-on period is a second interval larger than the first interval when the dimming level is lower than the reference dimming level.

According to some embodiments, the interval between the first gate-on period and the second gate-on period increases as the dimming level decreases in a first dimming period of which the dimming level is lower than the reference level.

According to some embodiments, the first gate-on period and the second gate-on period are continuous with each other in a second dimming period of which the dimming level is higher than the reference level.

According to some embodiments, the interval between the first gate-on period and the second gate-on period is a second interval smaller than the first interval in a second dimming period of which the dimming level is higher than the reference level.

According to some embodiments, a width of the first gate-on period and a width of the second gate-on period are constant regardless of the dimming level.

According to some embodiments, a width of at least one of the first gate-on period or the second gate-on period increases based on a predetermined dimming level as the dimming level decreases.

According to some embodiments, the gate-on periods include a first gate-on period and a second gate-on period, the scan driver is configured to supply j (j is a positive integer) scan signals to each of the scan lines in response to the first gate-on period of the scan start signal, and the scan driver is configured to supply k (k is an integer of 2 or more) scan signals to each of the scan lines in response to the second gate-on period of the scan start signal.

According to some embodiments, a number of scan signals supplied to each of the scan lines increases as a width of the second gate-on period increases.

According to some embodiments, the timing controller is configured to control a width of the gate-off period of the emission control start signal supplied to the emission driver based on the dimming level.

According to some embodiments, a width of the gate-off period of the emission control start signal is a first off-width when the dimming level corresponds to a predetermined reference dimming level, the width of the gate-off period of the emission control start signal increases as the dimming level decreases when the dimming level is lower than the reference dimming level, and the width of the gate-off period of the emission control start signal is a second off-width smaller than the first off-width regardless of the dimming level when the dimming level is higher than the reference dimming level.

According to some embodiments, the timing controller includes: a first start signal determiner configured to determine a width of the gate-off period of the emission control start signal based on a dimming signal including information of the dimming level; and a second start signal determiner configured to determine the interval between a first gate-on period and a second gate-on period of the scan start signal based on at least one of the dimming signal and the width of the gate-off period of the emission control start signal.

According to some embodiments, the display device further includes a data driver configured to supply a data signal to a plurality of data lines so as to be synchronized with a last scan signal of each of the plurality of scan lines among the scan signals supplied to each of the plurality of scan lines.

According to some embodiments, the scan driver is configured to supply a scan signal to each of the plurality of scan lines a plurality of times in response to the gate-on periods of the scan start signal within a non-emission period defined by a gate-off period of the emission control signal in one frame period.

According to some embodiments, the scan driver is configured to control an interval between the scan signal output in response to a first gate-on period and the scan signal output in response to a second gate-on period according to an interval between the first gate-on period and the second gate-on period of the scan start signal.

According to some example embodiments of the present invention, a display device includes: a display panel including a plurality of pixels; a scan driver configured to supply a scan signal to the plurality of pixels through a plurality of scan lines based on a scan start signal; an emission driver configured to supply an emission control signal to the plurality of pixels through a plurality of emission control lines based on an emission control start signal; and a timing controller configured to control a width of the scan start signal in a gate-off period of the emission control start signal defining a non-emission period of one frame based on a dimming level.

According to some embodiments, the scan start signal has a first width when the dimming level corresponds to a predetermined reference dimming level.

According to some embodiments, the scan start signal has a second width larger than the first width when the dimming level is lower than the reference dimming level.

According to some embodiments, a width of the scan start signal increases as the dimming level decreases when the dimming level is included in a first dimming period lower than the reference dimming level.

According to some embodiments, the scan start signal has a second width smaller than the first width when the dimming level is included in a second dimming period higher than the reference dimming level.

According to some embodiments, the scan start signal has a constant second width regardless of a change in the dimming level in the second dimming period.

According to some embodiments, the scan driver is configured to supply k (k is an integer of 2 or more) scan signals to each of the scan lines based on the width of the scan start signal.

According to some embodiments, the timing controller includes: a first start signal determiner configured to control a width of the gate-off period of the emission control start signal based on a dimming signal including information of the dimming level; and a second start signal determiner configured to control the width a the gate-on period of the scan start signal based on the dimming signal and the width of the gate-off period of the emission control start signal.

According to some example embodiments of the present invention, a timing controller includes: a first start signal determiner configured to determine a width of a gate-off period of an emission control start signal based on a dimming signal including information of a dimming level at which a display device emits light; and a second start signal determiner configured to determine at least one interval between a gate-on period of a scan start signal and at least one width of a gate-on period of the scan start signal based on the dimming signal.

According to some embodiments, the gate-on period includes a first gate-on period and a second gate-on period, and when the dimming level corresponds to a predetermined reference dimming level, the interval between the first gate-on period and the second gate-on period is a first interval.

According to some embodiments, the interval between the first gate-on period and the second gate-on period increases as the dimming level decreases in a first dimming period of which the dimming level is lower than the reference level.

According to some embodiments, the first gate-on period and the second gate-on period are continuous with each other in a second dimming period of which the dimming level is higher than the reference level.

According to some embodiments, the scan start signal has a first width when the dimming level corresponds to a predetermined reference dimming level.

According to some embodiments, a width of the scan start signal increases as the dimming level decreases when the dimming level is included in a first dimming period lower than the reference dimming level.

According to some embodiments, the scan start signal has a constant second width smaller than the first width regardless of a change in the dimming level when the dimming level is included in a second dimming period higher than the reference dimming level.

Therefore, display defects such as a color drag and afterimage due to an abrupt gradation change in low-luminance may be eliminated or reduced.

It should be understood, however, that the characteristics of the present invention are not limited to the characteristics described above, and various changes and modifications may be made without departing from the spirit and scope of the invention.

DETAILED DESCRIPTION

Figure 1:
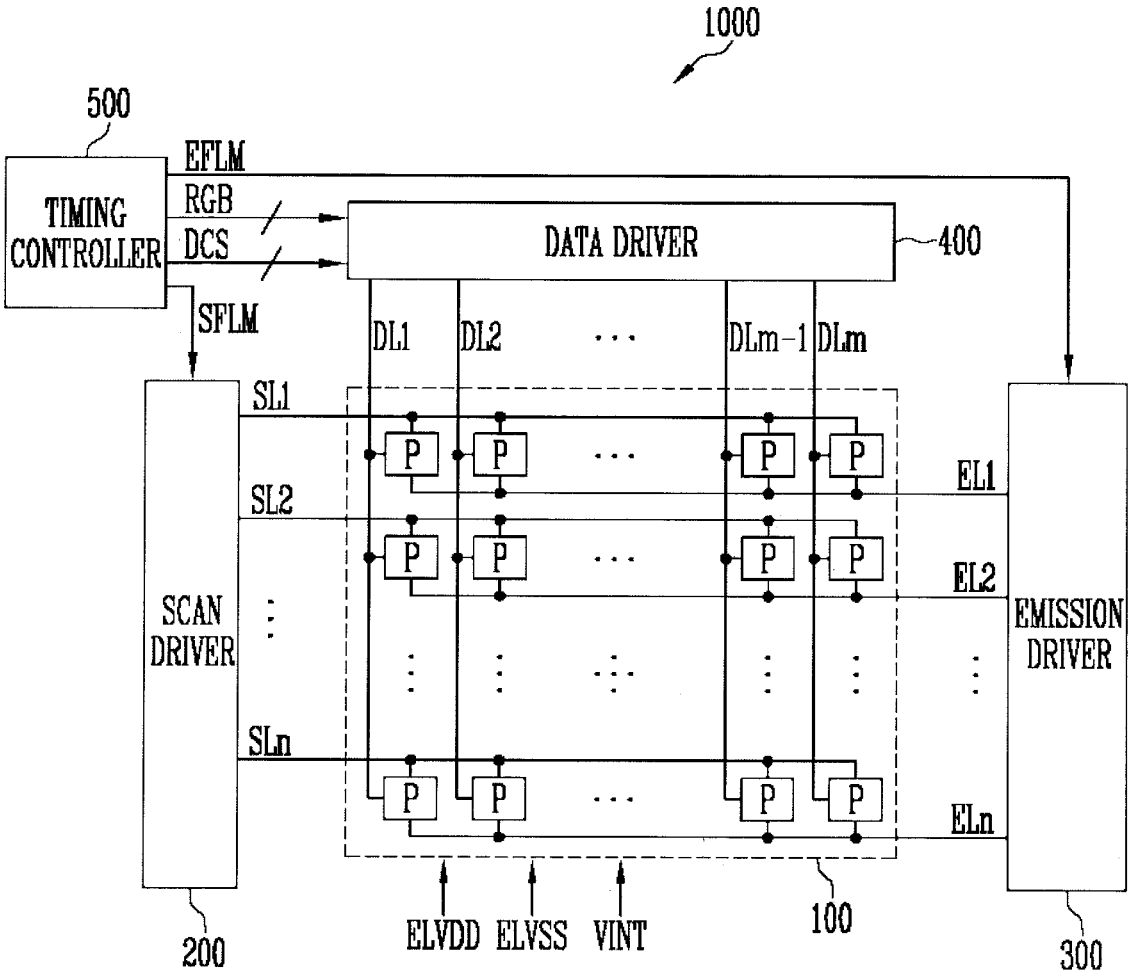
FIG. 1 is a block diagram showing a display device according to some example embodiments of the present invention.

Hereinafter, example embodiments of the present invention will be described in further detail with reference to the accompanying drawings. Like reference numerals are used for like elements in the drawings, and redundant explanations for like elements are omitted.

FIG. 1 is a block diagram showing a display device according to some example embodiments of the present invention.

Referring to FIG. 1, the display device 1000 may include a display panel 100, a scan driver 200, an emission driver 300, a data driver 400, and a timing controller 500.

The display device 1000 may be implemented as an organic light emitting diode display, a liquid crystal display, or the like. The display device 1000 may be a flat display device, a flexible display device, a curved display device, a foldable display device, or a bendable display device. In addition, the display device 1000 may be applied to a transparent display device, a head-mounted display device, a wearable display device, and the like.

The display panel 100 may include a plurality of scan lines SL1 to SLn, a plurality of emission control lines EL1 to ELn, and a plurality of data lines DL1 to DLm, and may include a plurality of pixels P connected to each of the scan lines SL1 to SLn, the emission control lines EL1 to ELn, and the data lines DL1 to DLm (wherein n and m are integers larger than 1). Each of the pixels P may include a driving transistor and a plurality of switching transistors. In an example embodiment, the pixels P may include organic light emitting diode display and each of the pixels P may be implemented as one of red, green, and blue pixels.

The scan driver 200 may supply the scan signals to the pixels P through the scan lines SL1 to SLn based on the scan start signal SFLM. The scan driver 200 receives the scan start signal SFLM and at least one clock signal from the timing controller 500. In an example embodiment, when the scan signal is supplied to the first scan line SL1, the pixels P may be sequentially selected by a horizontal line. For this purpose, the scan signal may be set to a gate-on voltage so that transistors included in the pixels P may be turned on. For example, when the transistor included in the pixels P is a P-channel metal oxide semiconductor (PMOS) transistor, the gate-on voltage may be set to a logic high level.

In an example embodiment, and the number of scan signals output may be different according to a width of the gate-on period of the scan start signal SFLM and the clock signal. This will be described later in more detail referring to FIG. 3 and the following drawings.

The emission driver 300 may supply the emission control signals to the pixels P through the emission control lines EL1 to ELn based on an emission control start signal EFLM. The emission driver 300 receives the emission control start signal EFLM and a clock signal from the timing controller 500. In an example embodiment, when the emission control signal is supplied to the first emission control line EL1, the pixels P may be sequentially selected by a horizontal line. For this purpose, the emission control signal may be set to a gate-on voltage so that the transistors included in the pixels P may be turned on. The emission control signal may divide one frame into an emission period and a non-emission period with respect to the horizontal lines.

The data driver 400 may receive a data control signal DCS and a video data signal RGB from the timing controller 500. The data driver 400 may supply the data signals to the pixels through the data lines DL1 to DLm based on the data control signal DCS and the video data signal RGB. In an example embodiment, in one frame, the data driver 400 may supply the data signals to the data lines DL1 to DLm to be synchronized with the last scan signal of each of the scan lines SL1 to SLn among the scan signals supplied to each of the scan lines SL1 to SLn.

The timing controller 500 may control driving of the scan driver 200, the emission driver 300, and the data driver 400 based on timing signals supplied from the outside. The timing controller 500 may supply a control signal including a scan start signal SFLM, a scan clock signal, and the like to the scan driver 200, and may supply a control signal including the emission control start signal EFLM, the emission control clock signal, and the like to the emission driver 300. The data control signal DCS for controlling the data driver 500 may include a source start signal, a source output enable signal, a source sampling clock signal, and the like.

In an example embodiment, the timing controller 500 may determine a dimming level at which the display panel 100 is currently emitting light based on a dimming signal supplied from the outside. Herein, dimming refers to a technique for limiting the maximum luminance (e.g., the luminance of the maximum gradation) that the display panel 100 may display. For example, the dimming refers to displaying an image by selecting one of a plurality of predetermined dimming levels, and the luminance of the maximum gradation may be changed to 350 nit, 250 nit, 200 nit, or the like according to the dimming level. For example, as the dimming level increases, the maximum luminance that the display panel can display increases.

In some example embodiments, the dimming may be implemented by various methods known at present, such as a data signal conversion, a gamma set selection, and a control of an off-duty ratio of the emission control signal. In addition, the dimming may be implemented in different ways according to a luminance period.

The timing controller 500 may determine a length (or a width) of the gate-off period of the emission control start signal EFLM based on the dimming level. In other words, the timing controller 500 may determine the length (e.g., an off-duty ratio) of the non-emission period in one frame based on the dimming level.

For example, at the predetermined reference dimming level, the gate-off period of the emission control start signal EFLM may have a first width. In the first dimming period in which the dimming level is lower than the reference dimming level, the gate-off period of the emission control start signal EFLM may have a second width larger than the first width. For example, the second width may increase as the dimming level decrease. In the second dimming period in which the dimming level is higher than the reference dimming level, the gate-off period of the emission control start signal EFLM may have a third width smaller than the first width. For example, the third width may have a constant value regardless of a change of the dimming level.

In an example embodiment, the timing controller 500 may control an interval between a first gate-on period and a second gate-on period of the scan start signal SFLM based on the dimming level in the gate-off period of the emission control start signal EFLM. A holding time of a threshold voltage bias of the driving transistor in the pixel P may be controlled according to the interval between the first gate-on period and the second gate-on period.

In an example embodiment, the timing controller 500 may control the width of the scan start signal SFLM (e.g., the width of the gate-on period of the scan start signal SFLM) based on the dimming level in the gate-off period of the emission control start signal EFLM. The number of scan signals supplied to the scan lines SL1 to SLn may change according to the width of the scan start signal SFLM. Therefore, an initialization of the on-bias state of the driving transistor in the pixel P may be applied differently according to the dimming level (e.g., the maximum luminance of the display panel 100).

A description related to a driving according to the dimming level will be described in more detail with reference to FIG. 2 and the following drawings.

Figure 2A:
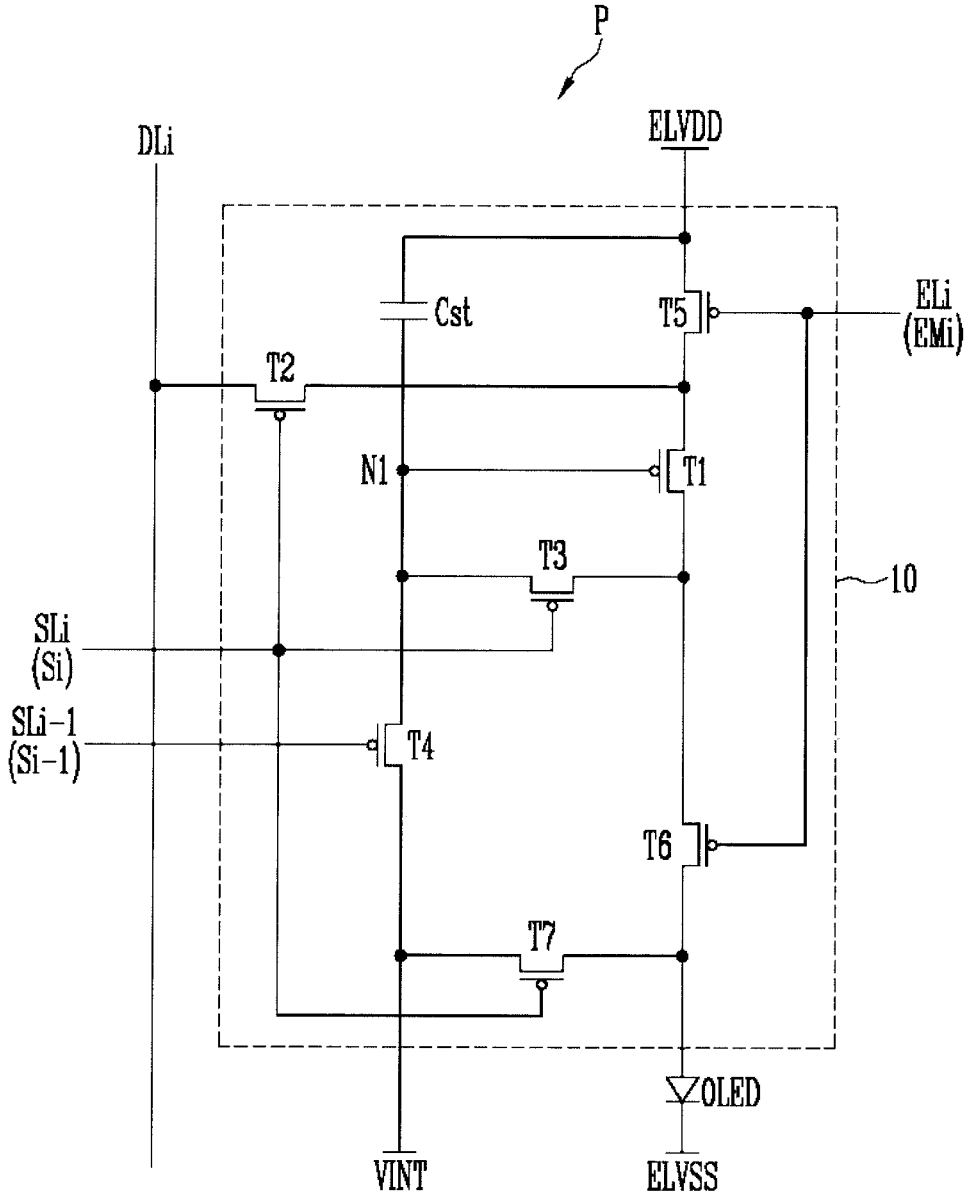
FIG. 2A is a circuit diagram showing an example of a pixel included in the display device of FIG. 1.
Figure 2B:
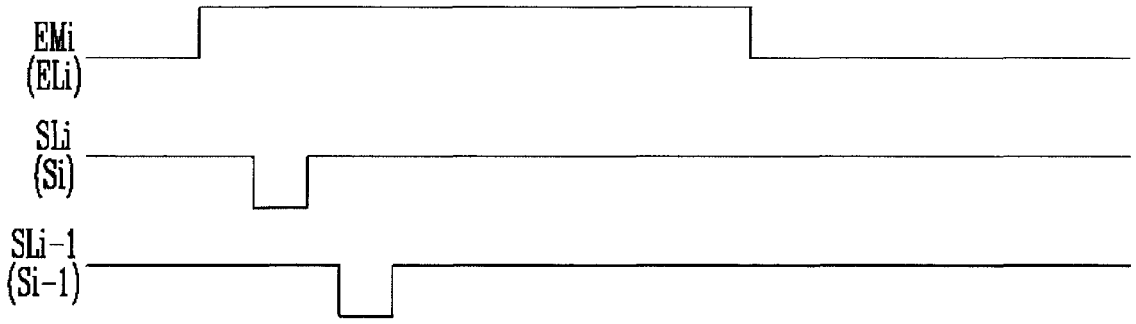
FIG. 2B is a waveform diagram showing an example of driving the pixel of FIG. 2A.

FIG. 2A is a circuit diagram showing an example of a pixel included in the display device of FIG. 1 and FIG. 2B is a waveform diagram showing an example of driving the pixel of FIG. 2A.

FIGS. 2A and 2B show a pixel P connected to the i-th data line Di, the (i-1) th scan line SLi-1 and the i-th scan line SLi for convenience of description.

Referring to FIGS. 2A and 2B, the pixel P may include the organic light emitting diode OLED and a pixel circuit 10 for controlling an amount of current supplied to the organic light emitting diode OLED.

The anode electrode of the organic light emitting diode OLED may be connected to the pixel circuit 10 and the cathode electrode of the organic light emitting diode OLED may be connected to the second power source ELVSS. The organic light emitting diode OLED may generate light of a predetermined luminance corresponding to the amount of current supplied from the pixel circuit 10.

The pixel circuit 10 may control the amount of current flowing from the first power source ELVDD via the organic light emitting diode OLED to the second power source ELVSS in response to the data signal. For this purpose, the pixel circuit 10 may include first to seventh transistors T1 to T7 and a storage capacitor Cst.

The seventh transistor T7 is connected between an initialization power supply VINT and the anode electrode of the organic light emitting diode OLED. A gate electrode of the seventh transistor T7 is connected to the ith scan line SLi. The seventh transistor T7 is turned on when a scan signal (e.g., GW signal) is supplied to the i-th scan line SLi to supply a voltage of the initialization power supply VINT to the anode electrode of the organic light emitting diode OLED. Herein, the initialization power supply VINT may be set to a voltage lower than the data signal.

The sixth transistor T6 is connected between the first transistor T1 and the organic light emitting diode OLED. A gate electrode of the sixth transistor T6 is connected to the i-th emission control line Eli. The sixth transistor T6 is turned on when the emission control signal EMi is supplied to the i-th emission control line ELi, and is turned off in the other cases. For example, the sixth transistor T6 may be turned on in the gate-on period of the emission control signal supplied to the i-th emission control line ELi, and may be turned off in the gate-off period.

The fifth transistor T5 is connected between the first power source ELVDD and the first transistor T1. A gate electrode of the fifth transistor T5 is connected to the i-th emission control line Eli. The fifth transistor T5 is turned off when the emission control signal EMi is supplied to the i-th emission control line ELi, and is turned on in other cases.

The first electrode of the first transistor T1 (e.g., a driving transistor) is connected to the first power source ELVDD via the fifth transistor T5, and the second electrode of the first transistor T1 is connected to the anode electrode of the organic light emitting diode OLED via the sixth transistor T6. A gate electrode of the first transistor T1 is connected to the first node N1. The first transistor T1 controls an amount of current flowing from the first power source ELVDD via the organic light emitting diode OLED to the second power source ELVSS in response to a voltage of the first node N1.

The third transistor T3 is connected between the second electrode of the first transistor T1 and the first node N1. The gate electrode of the third transistor T3 is connected to the ith scan line SLi. The third transistor T3 is turned on when a scan signal is supplied to the ith scan line SLi to electrically connect the second electrode of the first transistor T1 to the first node N1. Therefore, when the third transistor T3 is turned on, the first transistor T1 may be connected in a diode form (e.g., diode-connected).

The fourth transistor T4 is connected between the first node N1 and the initialization power supply VINT. The gate electrode of the fourth transistor T4 is connected to the i-1-th scan line SLi-1. The fourth transistor T4 may be turned on when a scan signal is supplied to the i-1-th scan line SLi-1 to supply a voltage of the initialization power source VINT to the first node N1.

Herein, a scan signal supplied to the i-th scan line SLi may correspond to a scan signal Si output from the i-th stage of the scan driver, and a scan signal supplied to the i-1-th scan line SLi-1 may correspond to a scan signal Si-1 output from the i-1-th stage of the scan driver.

The second transistor T2 is connected between the data line Di and the first electrode of the first transistor T1. A gate electrode of the second transistor T2 is connected to the i-th scan line SLi. The second transistor T2 may be turned on when a scan signal is supplied to the i-th scan line SLi to electrically connect the data line DLi and the first electrode of the first transistor T1.

The storage capacitor Cst is connected between the first power supply ELVDD and the first node N1. The storage capacitor Cst may store a voltage corresponding to the data signal and the threshold voltage of the first transistor T1.

In some example embodiments, the number of scan signals supplied to each of the second, third, fourth, and seventh transistors T2, T3, T4, and T7 and the width between the scan signals are controlled through the control of the width and/or the interval of the scan start signal. Therefore, the bias holding time of the driving transistor may be controlled.

As shown in FIG. 2B, the fifth transistor T5 and the sixth transistor T6 are turned off in the gate-off period of the emission control signal EMi supplied to the emission control line ELi. At this time, the pixel P is set to a non-emission state.

Thereafter, the scan signal Si-1 is supplied to the i-1-th scan line SLi-1 to turn on the fourth transistor T4. When the fourth transistor T4 is turned on, the voltage of the initialization power supply VINT is supplied to the first node N1. Then, the voltage of the first node N1 is initialized to the voltage of the initializing power supply VINT. Herein, the voltage of the first node N1 may be a gate voltage of the driving transistor (e.g., the first transistor T1). Therefore, the first transistor T1 is initialized to an on-bias state.

After the first node N1 is initialized to the voltage of the initializing power supply VINT, the scan signal Si is supplied to the scan line SLi. When the scan signal is supplied to the i-th scan line Si, the second transistor T2, the third transistor T3 and the seventh transistor T7 are turned on.

When the third transistor T3 is turned on, the first transistor T1 is connected in a diode form.

When the second transistor T2 is turned on, a data signal from the data line DLi is supplied to the first electrode of the first transistor T1. At this time, because the first node N1 is initialized to the voltage of the initialization power supply VINT lower than the data signal, the first transistor T1 is turned on. When the first transistor T1 is turned on, a voltage obtained by subtracting the threshold voltage of the first transistor T1 from the data signal is supplied to the first node N1. The storage capacitor Cst stores a voltage corresponding to the data signal supplied to the first node N1 and the threshold voltage of the first transistor T1. At this time, the first transistor T1 may have a gate-source voltage of about 0V and a drain-source voltage of about 0V. Therefore, the first transistor Ti may be in an off-bias state (or a threshold voltage bias state) in which the gate-source voltage of about 0 V and the drain-source voltage of about 0 V are supplied.

When the seventh transistor T7 is turned on, the voltage of the initialization power supply VINT is supplied to the anode electrode of the organic light emitting diode OLED. That is, the voltage of the anode electrode of the organic light emitting diode OLED may be initialized. Then, a parasitic capacitor formed in the organic light emitting diode OLED is discharged, thereby improving a black display capability. When the parasitic capacitor of the organic light emitting diode OLED is discharged, a leakage current of the first transistor T1 precharges the parasitic capacitor of the organic light emitting diode OLED so that the organic light emitting diode OLED may maintain a non-emission state (e.g., a black state).

After the voltage corresponding to the data signal and the threshold voltage of the first transistor T1 are stored in the storage capacitor Cst, the emission control signal EMi supplied to the i-th emission control line ELi has a gate-on voltage, and the gate-on period may be started. At this time, the fifth transistor T5 and the sixth transistor T6 are turned on. Then, a current path is formed from the first power source ELVDD to the second power source ELVSS via the fifth transistor T5, the first transistor T1, the sixth transistor T6 and the organic light emitting diode OLED. At this time, the first transistor T1 controls the amount of current flowing to the organic light emitting diode OLED corresponding to the voltage of the first node N1. The organic light emitting diode OLED generates light of a predetermined luminance corresponding to the amount of current supplied from the first transistor T1.

In practice, the pixel P generates light of a predetermined luminance while repeating the process described above. In addition, a circuit structure of the pixel P in an example embodiment of the present invention is not limited to FIG. 2A, and may be implemented with various types of circuits known in the art.

The emission control signal EMi is supplied to overlap with at least one scan signal so that the pixel P is set to the non-emission state during the period in which the data signal is charged in the pixel P. A supply timing of such a emission control signal EMi may be set by various methods known in the art.

According to some example embodiments, a length of the gate-off period of the emission control signal EMi, the number of the scan signals Si-1 and Si, and a width of the scan signals Si-1 and Si may be controlled based on the dimming level.

Figure 3:
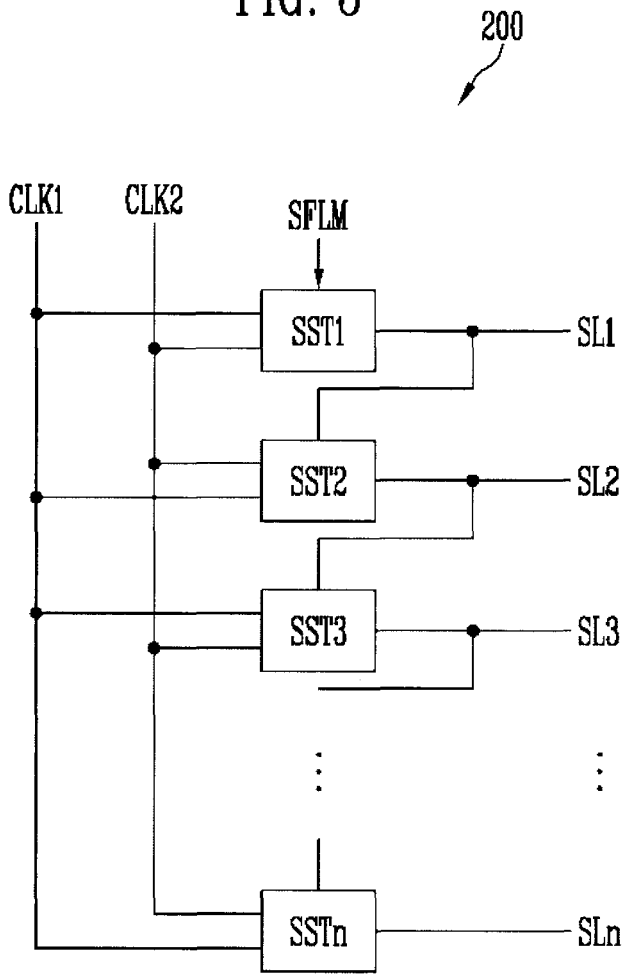
FIG. 3 is a block diagram showing an example of a scan driver included in the display device of FIG. 1.
Figure 4A:
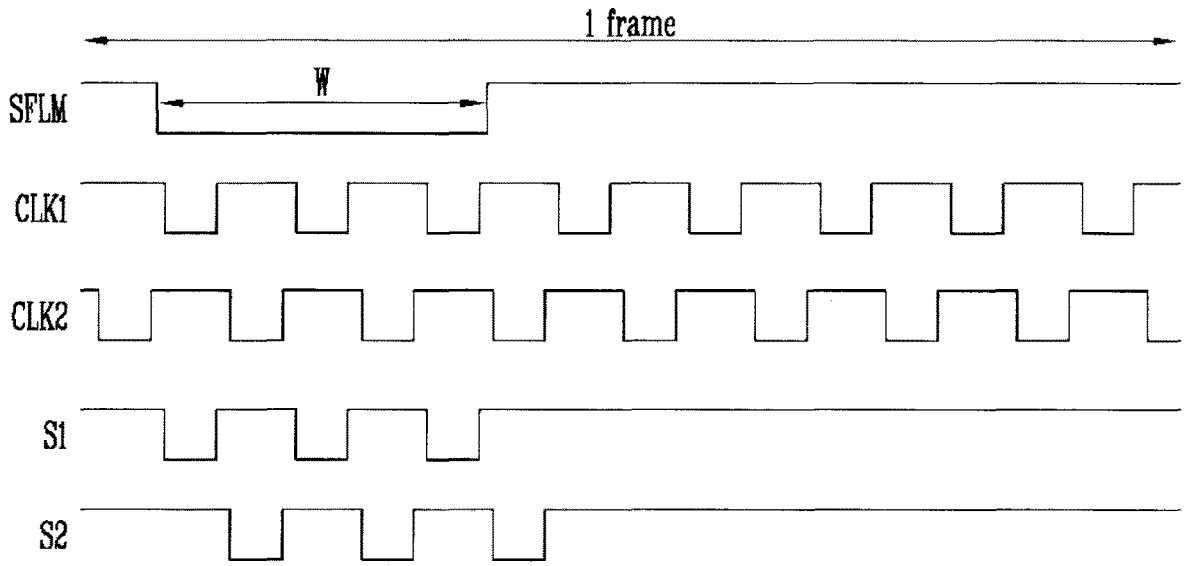
FIGS. 4A and 4B are waveform diagrams showing examples of an operation of the scan driver of FIG. 3.
Figure 4B:
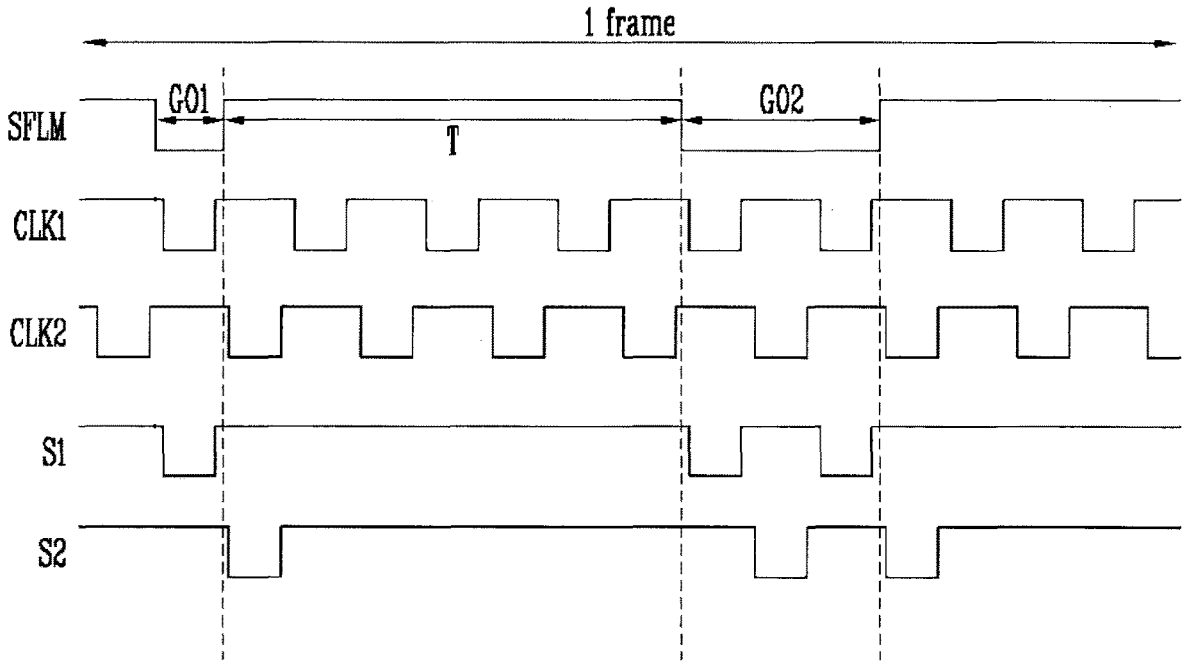

FIG. 3 is a block diagram showing an example of a scan driver included in the display device of FIG. 1, and FIGS. 4A and 4B are waveform diagrams showing examples of an operation of the scan driver of FIG. 3.

Referring to FIGS. 3 to 4B, the scan driver 200 may include the first to n-th stages SST1 to SSTn connected to the scan lines SL1 to SLn, respectively. The scan driver 200 may output the scan signals S1, S2, . . . based on the scan start signal SFLM and the first and second clock signals CLK1 and CLK2.

Each of the stages SST1 to SSTn may be supplied with first and second clock signals CLK1 and CLK2, and may supply scan signals S1, S2, . . . to each of the scan lines SL1 to SLn in response to the scan start signal SFLM.

For example, the first stage SST1 may supply the first scan signal S1 to the first scan line SL1 in response to the scan start signal SFLM. The second stage SST2 may supply the second scan signal S2 to the second scan line SL2 in response to the first scan signal S1.

Herein, the number of each of the scan signals S1, S2, . . . supplied to each of the scan lines SL1 to SLn may be determined corresponding to the width W of the scan start signal SFLM. For example, a larger number of scan signals S1, S2, . . . may be supplied to the scan lines SL1 to SLn as the width W of the scan start signal SFLM increases.

The scan start signal SFLM may be supplied to the first stage SST1 with a predetermined width in response to the dimming level. At this time, the first stage SST1 may supply the first clock signal CLK1 overlapping the scan start signal SFLM to the first scan line SL1 as the first scan signal S1.

For example, as shown in FIG. 4A, the first stage SST1 may supply three first scan signals S1 which overlaps the scan start signal SFLM to the first scan line SL1. The second stage SST1 may receive the three first scan signals S1, and may output the second scan signals S2 corresponding to the second clock signal CLK2 delayed by half a period of the first clock signal CLK1 to the second scan line SL2. Therefore, the number of the second scan signals S2 is the same as the number of the first scan signals S1. Accordingly, the scan signals having the same number may be sequentially supplied to the scan lines SL1 to SLn.

In addition, in one frame period, the scan start signal SFLM may include a plurality of gate-on periods. For example, as shown in FIG. 4B, the scan signal SFLM may have a first gate-on period GO1 and a second gate-on period GO2. The width of the first gate-on period GO1 and the width of the second gate-on period GO2 may be equal to each other or may be different from each other. In one frame period, the interval at which the scan signal (e.g., S1) is supplied to one scan line (e.g., SL1) may be determined corresponding to the interval between the gate-on periods of the scan start signal SFLM.

For example, in the first gate-on period GO1, one first scan signal S1 may be supplied to the first scan line SL1 in response to the scan start signal SFLM. In the second gate-on period GO2, two first scan signals S1 may be supplied to the first scan line SL1 in response to the scan start signal SFLM.

The timing of providing the scan signals supplied to each of the scan lines S1 to Sn by the interval T between the first gate-on period GO1 and the second gate-on period GO2 of the scan start signal SFLM, may be changed. For example, in one frame period, one scan signal S1 may be supplied to the first scan line SL1 and two scan signals S1 may be further supplied after a predetermined time elapses. During a time corresponding to the interval T between the first gate-on period GO1 and the second gate-on period GO2, the transistors of the pixel to which the scan signal is supplied have a turn-off state, and the driving transistor (e.g., the first transistor, T1) of the pixel may have an off-bias state.

On/off of the transistors is controlled by a scan signal supplied to the pixel P. In some example embodiments of the present invention, as shown in FIG. 2A, the transistors of the pixel P may be composed of a PMOS transistor. For example, when the scan signal S1 is supplied to the first scan line SL1 to turn on the fourth transistor T4, the first transistor T1 (e.g., the driving transistor) is in an on-bias state and a characteristic graph of the first transistor T1 (e.g., a characteristic graph of a drain current according to a gate-source voltage) is shifted in the negative direction. On the contrary, when the scan signal S1 is supplied to the first scan line SL1 and a turn-off state of the transistors is kept long, the first transistor T1 is in an off-bias state (or a threshold voltage bias state), and the characteristic graph is shifted in the positive direction. Accordingly, some example embodiments of the present invention may display a high-quality image using the characteristic change of the first transistor T1 according to the change of the bias state by controlling the output of the scan signal. That is, by controlling the time and/or the number that the first transistor T1 has the on-bias state and the threshold voltage bias state in one frame period, a color drag, afterimage, or the like due to abrupt gradation change or luminance change may be reduced.

Figure 5:
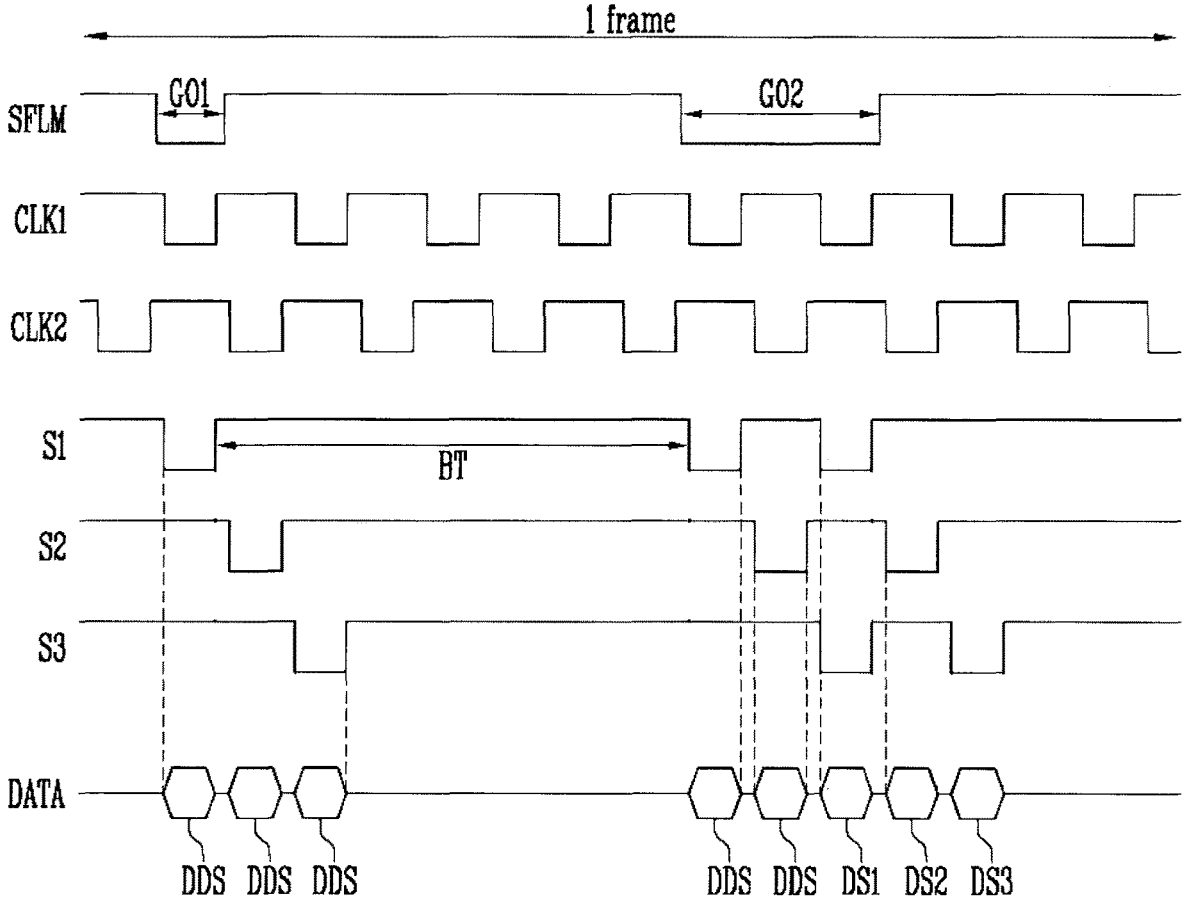
FIG. 5 is a waveform diagram showing an example of scan signals supplied to a display panel of the display device of FIG. 1.

FIG. 5 is a waveform diagram showing an example of scan signals supplied to a display panel of the display device of FIG. 1.

Referring to FIG. 5, the data signal DATA may be supplied to the display panel 100 in synchronization with the last scan signal supplied to one scan line in one frame period.

As described above, in one frame period, the scan start signal SFLM may include a plurality of gate-on periods GO1 and GO2, and the scan driver 200 may supply a plurality of scan signals at a predetermined interval to one scan line based on the scan start signal SFLM. For example, as shown in FIG. 5, for one scan line, one scan signal may be output and two scan signals may be output after a predetermined bias time BT has elapsed. The data driver 400 may supply data signals DS1 corresponding to the first horizontal line of the pixels to the data lines D1 to Dm so as to be synchronized with the last first scan signal among the first scan signals S1 supplied to the first scan line. Thereafter, the data driver 400 may sequentially supply the data signals DS2, DS3, . . . corresponding to the next horizontal lines to the data lines D1 to Dm.

The data signals DS1, DS2, DS3, . . . from the data driver 400 may be supplied to the display panel 100 corresponding to the scan signals S1, S2, S3 supplied sequentially so that the display panel 100 may display a predetermined image corresponding to the data signals DS1, DS2, DS3, In addition, the data driver 400 may supply a dummy data signal DDS before the data signal DS1 corresponding to the first horizontal line is supplied. The dummy data signal DDS may be selected as any one of the data signals which may be supplied from the data driver 400.

FIGS. 6A to 6D are waveform diagrams showing examples of an operation of the display device of FIG. 1 based on a dimming level according to the embodiments of the present invention.

Referring to FIGS. 6A to 6D, the timing controller 500 may control the emission control start signal EFLM and the scan start signal SFLM according to the dimming level DIM.

Figure 6A:
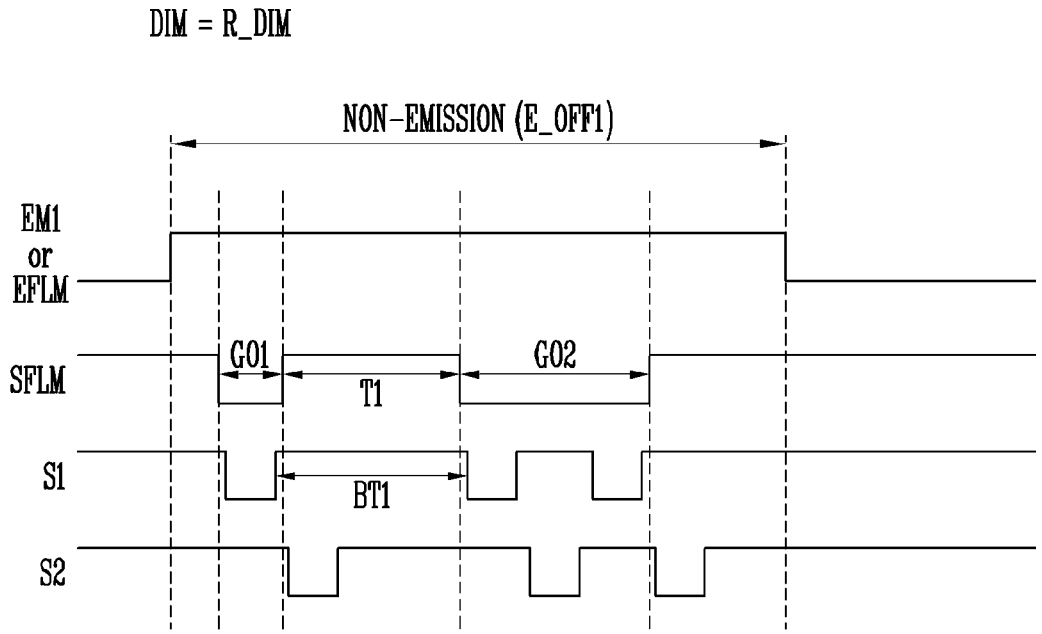
FIGS. 6A to 6D are waveform diagrams showing examples of an operation of the display device of FIG. 1 based on a dimming level according to some example embodiments of the present invention.

In some example embodiments, as shown in FIG. 6A, when a current dimming level DIM corresponds to the predetermined reference dimming level R_DIM, the gate-off period of the emission control start signal EFLM may have the first off-width E_OFF1. For example, the reference dimming level R_DIM may be set to a maximum luminance of about 100 nit. At a low-luminance lower than the reference dimming level R_DIM, the dimming may be controlled by a length of an emission period (i.e., a control of an off duty ratio). That is, the reference dimming level R_DIM refers to a reference luminance for starting dimming by controlling the length of the emission period.

In addition, the width of the emission control signal EM1 supplied to the first emission control line may be substantially equal to the width of the emission control start signal EFLM. On the other hand, the first off-width E_OFF1 of the emission control start signal EFLM refers to a non-emission period in one frame period.

In addition, when the dimming level DIM corresponds to the predetermined reference dimming level R_DIM, the interval between the first gate-on period GO1 and the second gate-on period GO2 of the scan start signal SFLM may be set to have the first interval T1. For example, the first gate-on period GO1 of the scan start signal SFLM may correspond to one scan signal and the second gate-on period GO2 of the scan start signal SFLM may correspond to two scan signals.

However, the number of gate-on periods of the scan start signal SFLM, the width of each gate-on period, and the interval between the gate-on periods are not limited thereto.

For example, the scan driver 200 may supply j (j is a positive integer) scan signals to each of the scan lines in response to the first gate-on period GO1 of the scan start signal SFLM, and the scan driver 200 may supply k (k is an integer of 2 or more) scan signals to each of the scan lines in response to the second gate-on period GO2. In this case, as shown in FIG. 6A to 6C, as the width of the first gate-on period GO1 and/or the width of the second gate-on period GO1 increases, the number of scan signals supplied to each of the scan lines may increase.

The driving method of FIG. 6A is a driving method capable of maintaining a threshold voltage bias state (e.g., an off-bias state) for a sufficient time (e.g., the bias holding time BT1 corresponding to the interval T1 between the first gate-on period GO1 and the second gate-on period GO2) after the scan signal is supplied in the first gate-on period GO1 to initialize the first transistor (T1, driving transistor) of the pixel to the on-bias state. Therefore, a hysteresis of the first transistor may be removed before a substantial data signal is supplied to a corresponding horizontal line. That is, in the first gate-on period GO1, a characteristic curve of the first transistor T1 is shifted in the negative direction and the first transistor T1 is initialized by an on-bias, and in the bias holding time BT1, the first transistor T1 maintains an initialized state as a threshold voltage bias state, so that the characteristic curve is shifted again in the positive direction and the hysteresis and the emission delay may be reduced. For example, the threshold voltage bias may correspond to a voltage value corresponding to about 150 gray levels. Therefore, when the gradation rapidly changes from a low gradation (e.g., a black gradation) to a high gradation (e.g., a white gradation) in a low-luminance region of 100 nit or less, the hysteresis and the emission delay may be reduced by the control of an output of the scan signal by a setting of the first gate-on period GO1 and the second gate-on period GO2, and display defects such as an afterimage, a color drag, or the like may be reduced.

In this case, the data signal corresponding to the horizontal line in response to the last scan signal of each of the scan signals S1 and S2 is supplied.

Figure 6B:
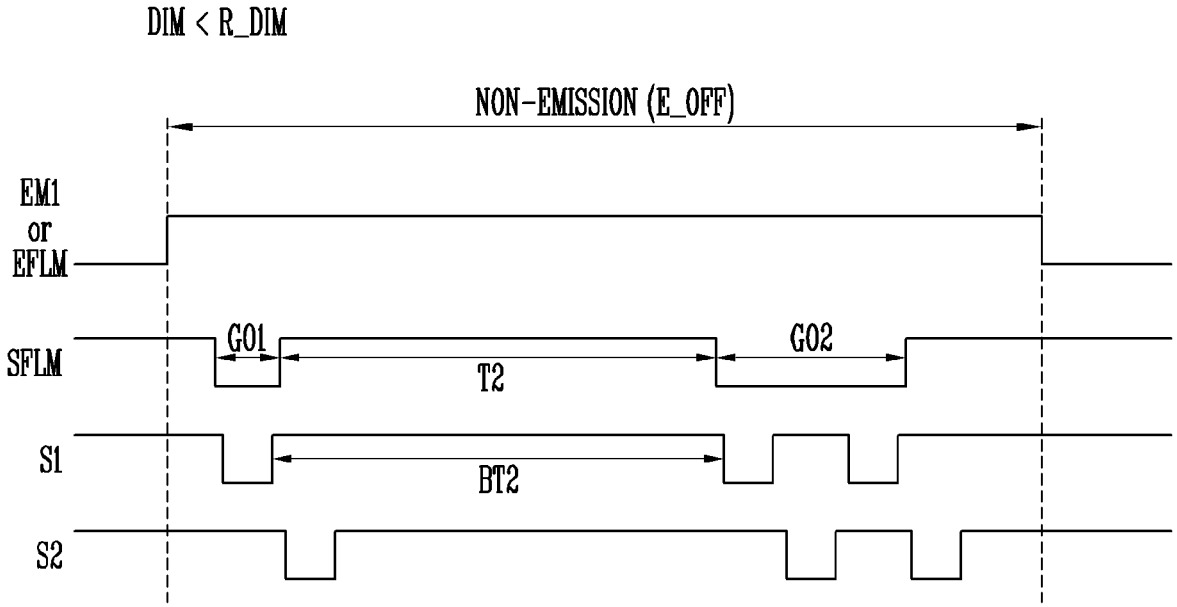
Figure 6C:
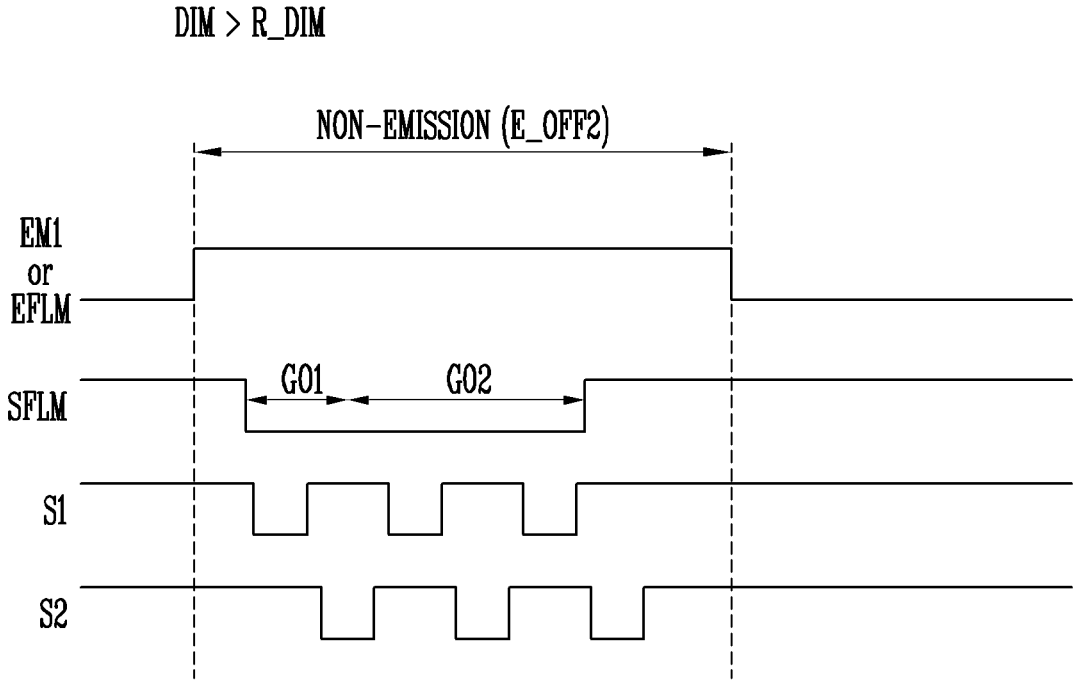

As shown in FIG. 6B, when the dimming level DIM is lower than the reference dimming level R_DIM, the gate-off period of the emission control start signal EFLM may be wider than the first off-width E_OFF1. In addition, the interval between the first gate-on period GO1 and the second gate-on period GO2 may be a second interval T2 larger than the first interval T1.

In the case of an ultralow-luminance emission in which the dimming level DIM is lower than the reference dimming level R_DIM, display defects such as a color drag, an afterimage, or the like are observed more easily by the user. To remedy this problem, in some example embodiments of the present invention, when the dimming level DIM is lower than the reference dimming level R_DIM, the larger the interval T2 between the first gate-on period GO1 and the second gate-on period GO2 may increase as the dimming level DIM decrease. Therefore, the bias holding time BT2 in a low-luminance dimming period in which the dimming level is lower than the reference dimming level R_DIM becomes longer than the bias holding time BT2 of the reference dimming level R_DIM.

Therefore, display defects such as a color drag or the like due to abrupt changes from a low gradation (e.g., a black gradation) to a high gradation (e.g., a white gradation) may be reduced.

In some example embodiments, the width of at least one of the first gate-on period GO1 and the second gate-on period GO2 may increase according to a predetermined dimming level DIM as the dimming level DIM decreases.

As shown in FIG. 6C, when the dimming level DIM is higher than the reference dimming level R_DIM, the gate-off period of the emission control start signal EFLM may be set to the second off-width E_OFF2 narrower than the first off-width E_OFF1. In addition, the first gate-on period GO1 and the second gate-on period GO2 may be continuous with each other. For example, when the display panel 100 emits light with a luminance larger than 100 nit, the timing controller 500 may successively output the first gate-on period GO1 and the second gate-on period GO2 in one frame period. That is, the scan start signal SFLM may be output with one gate-on interval in which the first gate-on period GO1 and the second gate-on period GO2 are continuous. In some example embodiments, the width of the first gate-on period GO1 and the second gate-on period GO2 which are continuous may be substantially equal to the sum of the width of the first gate-on period GO1 and the width of the second gate-on period GO2 in FIGS. 6A and 6B. However, this embodiment is only an example, and when the dimming level DIM is higher than the reference dimming level R_DIM, the width of the gate-on period of the scan start signal SFLM may be smaller than the sum of the width of the first gate-on period GO1 and the width of the second gate-on period GO2.

In some example embodiments, when the dimming level DIM is higher than the reference dimming level R_DIM, a dimming by controlling an off-duty ratio of the emission control signal is not performed. Therefore, the second off-width E_OFF2, which is the width of the gate-off period of the emission control start signal EFLM, may be constant regardless of a change in the dimming level DIM. Further, when the dimming level DIM is higher than the reference dimming level R_DIM, the width of the first gate-on period GO1 and the width of the second gate-on period GO2 may be constant regardless of the dimming level DIM. In the case of a high-luminance emission in which the dimming level DIM is higher than the reference dimming level R_DIM, the color drag or the afterimage due to the hysteresis is not well observed, so that the bias holding time of the scan signals S1 and S2 is not set in the present embodiment.

Figure 6D:
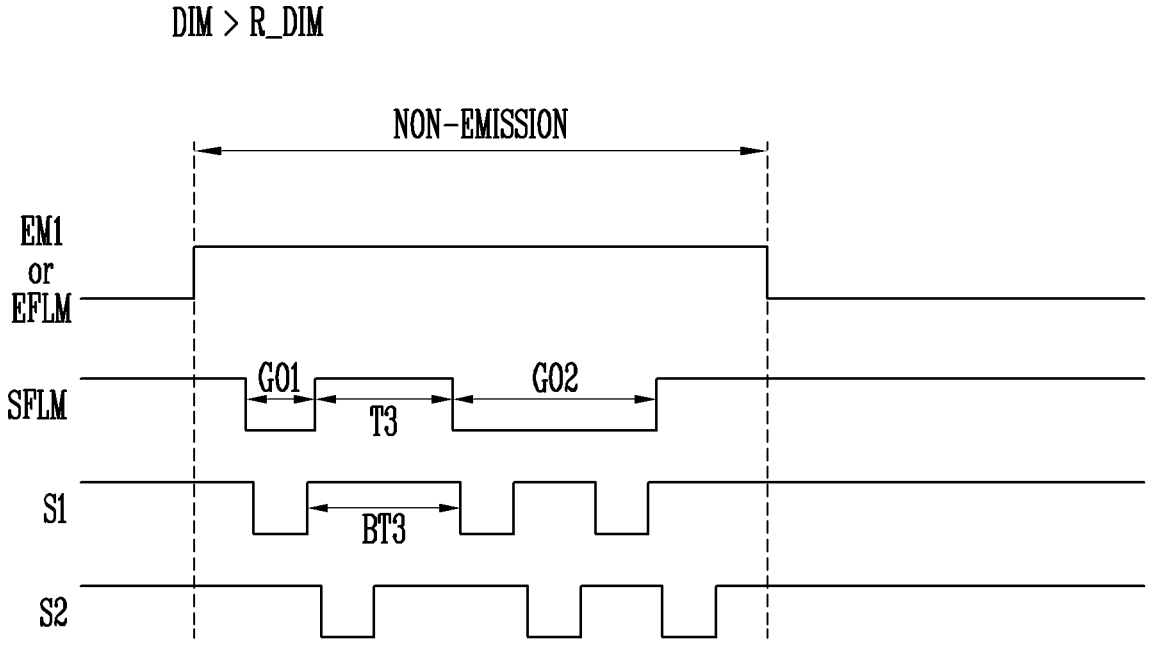

In some example embodiments, as shown in FIG. 6D, when the dimming level DIM is higher than the reference dimming level R_DIM, the interval between the first gate-on period GO1 and the second gate-on period GO2 may be the third interval T3 smaller than the first interval T1. Therefore, even at a high-luminance emission in which the dimming level is higher than the reference dimming level (R_DIM), a predetermined bias holding time BT3 may be ensured.

As described above, the display device 100 according to some example embodiments of the present invention may improve poor visibility due to an abrupt gradation change in the low-luminance region by controlling the interval between the gate-on periods GO1 and GO2 of the scan control signal SFLM in the low-luminance region based on the dimming level.

Figure 7:
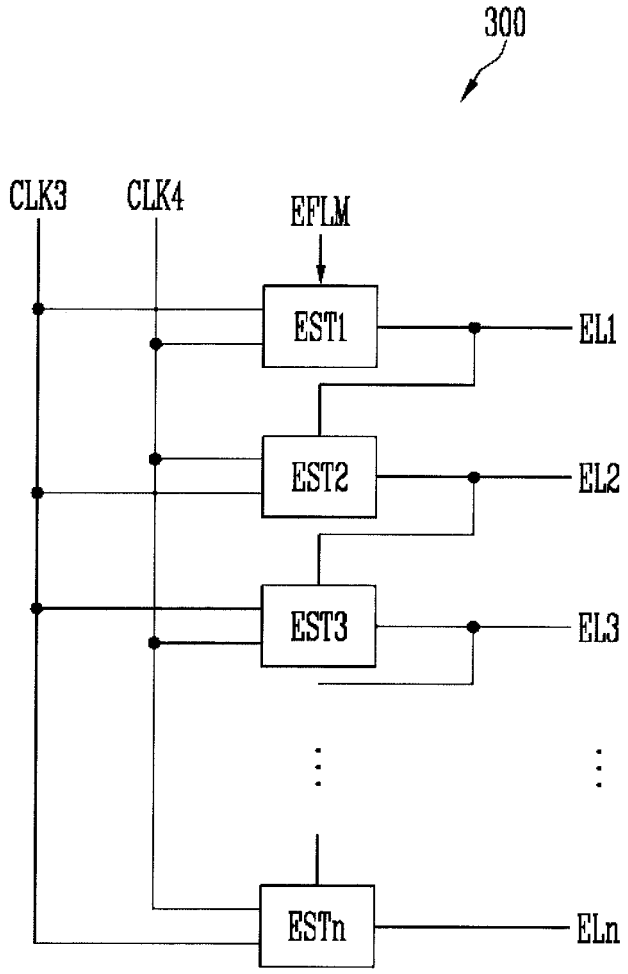
FIG. 7 is a block diagram showing an example of an emission driver included in the display device of FIG. 1.
Figure 8A:
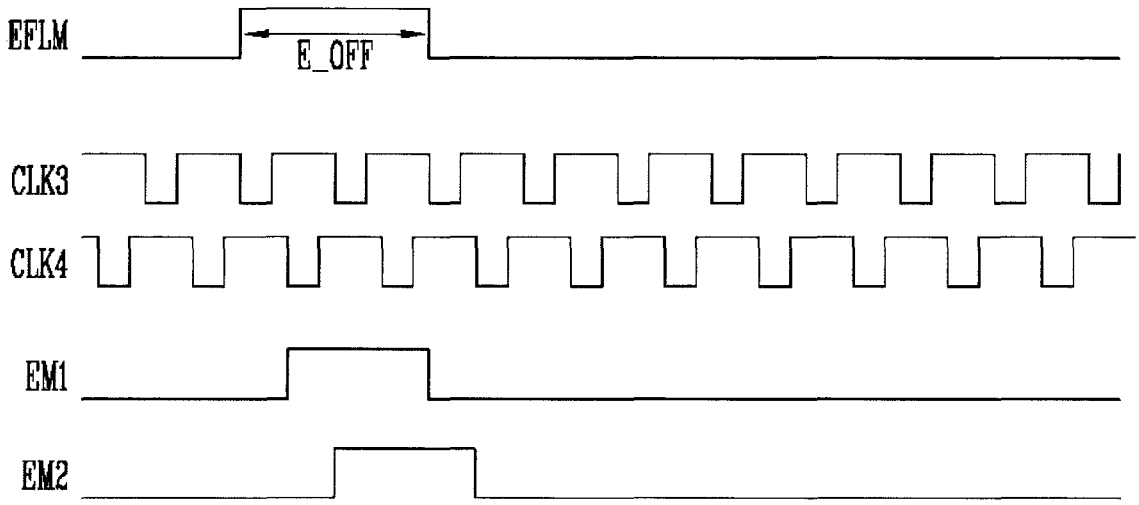
FIGS. 8A and 8B are waveform diagrams showing examples of an operation of the emission driver of FIG. 7.
Figure 8B:
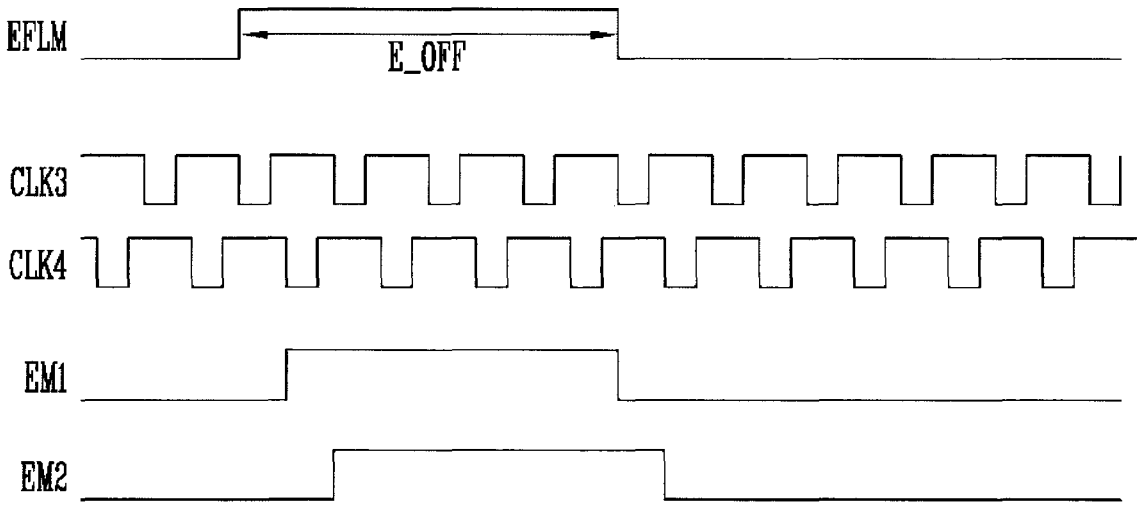

FIG. 7 is a block diagram showing an example of an emission driver included in the display device of FIG. 1, and FIGS. 8A and 8B are waveform diagrams showing examples of an operation of the emission driver of FIG. 7.

Referring to FIGS. 7 to 8B, the emission driver 300 may include the first to n-th stages EST1 to ESTn connected to the emission control lines EL1 to ELn, respectively. The emission driver 300 may output the emission control signals EM1, EM2, . . . based on the emission control start signal EFLM and the third and fourth clock signals CLK3 and CLK4.

The first stage EST1 may supply the first emission control signal EM1 to the first emission control line EL1 in response to the emission control start signal EFLM. The second stage EST2 may supply the second emission control signal EM2 to the second emission control line EL2 in response to the first emission control signal EM1.

In this case, as shown in FIGS. 8A and 8B, the width of the gate-off period of the emission control signals EM1, EM2, . . . may be determined corresponding to the width of the gate-off period E_OFF of the emission control start signal EFLM. That is, the width of the emission control signals EM1, EM2, . . . is set to be wider as the width of the emission control start signal EFLM becomes wider. The width of the gate-off period E_OFF of the emission control start signal EFLM may be determined by the dimming level.

Figure 9A:
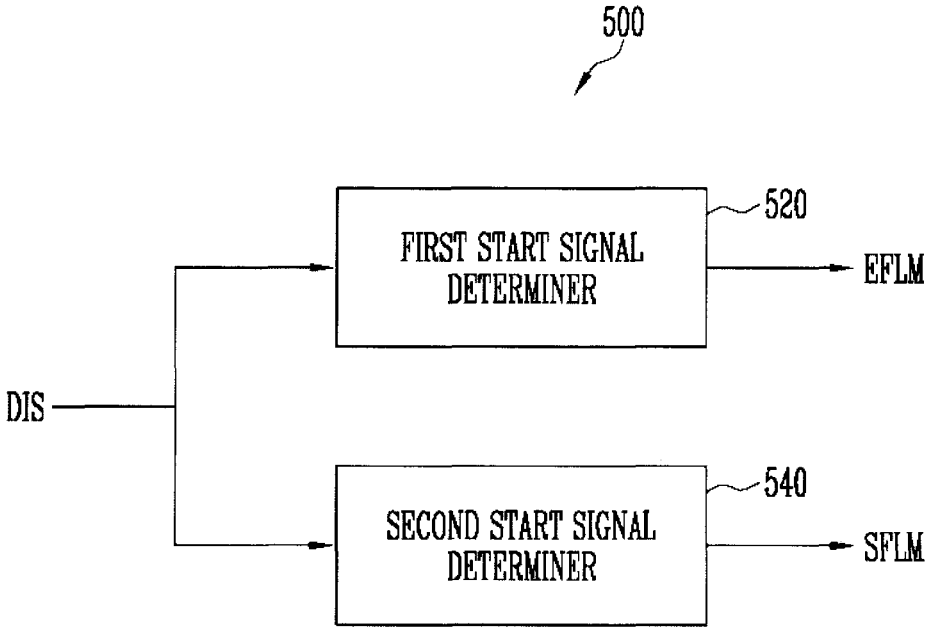
FIGS. 9A to 9C are block diagrams showing examples of a timing controller included in the display device of FIG. 1.
Figure 9B:
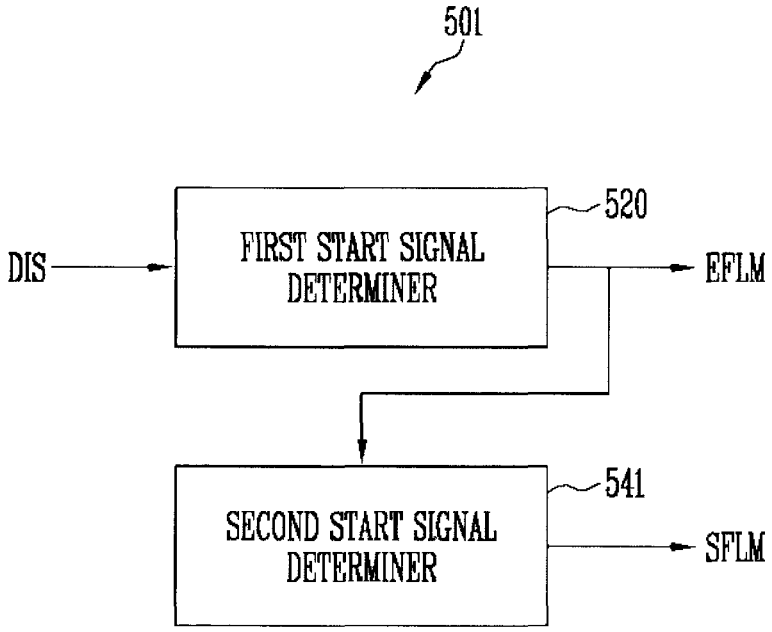
Figure 9C:
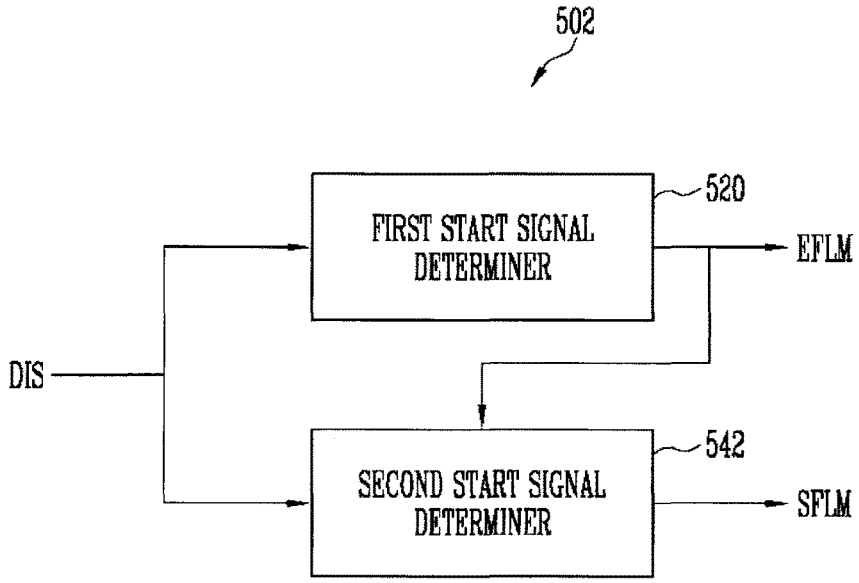

FIGS. 9A to 9C are block diagrams showing examples of a timing controller included in the display device of FIG. 1.

Referring to FIGS. 9A to 9C, the timing controller 500, 501, and 502 may include a first start signal determiner 520 and a second start signal determiner 540, 541, and 542.

The first start signal determiner 520 may determine the width of the gate-off period of the emission control start signal EFLM based on the dimming signal DIS including information of the dimming level. The dimming signal DIS may include one of information of a predetermined dimming level. In some example embodiments of the present invention, the first start signal determiner 520 may determine the emission control start signal EFLM from a look-up table storing the relationship between the dimming level and the width of the gate-off period of the emission control start signal EFLM. However, the configuration in which the first start signal determiner 520 determines the gate-off period of the emission control start signal EFLM is not limited to this example embodiment.

The second start signal determiner 540, 541, 542 may determine the width of the scan start signal SFLM (i.e., the width of the gate-on period), the number of gate-on periods of the scan start signal SFLM, and the interval between the gate-on periods based on at least one of the dimming signal DIS and the emission control start signal EFLM. For example, as shown in FIG. 9A, the second start signal determiner 540 may determine the interval between the first gate-on period and the second gate-on period of the scan start signal SFLM in response to the dimming signal DIS.

As another example, as shown in FIG. 9B, the second start signal determiner 541 may determine an interval between the first gate-on period and the second gate-on period of the scan start signal SFLM based on the width of the gate-off period of the emission control start signal EFLM. In this case, the second start signal determiner 541 may receive information related to the emission control start signal EFLM from the first start signal determiner 520.

As another example, as shown in FIG. 9C, the second start signal determiner 542 may determine an interval between the first gate-on period and the second gate-on period of the scan start signal SFLM referring to both the emission control start signal EFLM and the dimming signal DIS.

In some example embodiments, the second start signal determiner 542 may output one scan start signal SFLM and may determine the width of the scan start signal SFLM based on at least one of the emission control start signal EFLM and the dimming signal DIS.

The contents related to a control of the scan start signal SFLM and the emission control start signal EFLM based on the dimming level have been described above with reference to FIGS. 6A to 6D, and a duplicate description thereof will be omitted.

As described above, by controlling the waveforms of the scan start signal SFLM and the emission control start signal EFLM based on the dimming level, display defects due to a gradation change in a low-luminance emission may be reduced.

Figure 10A:
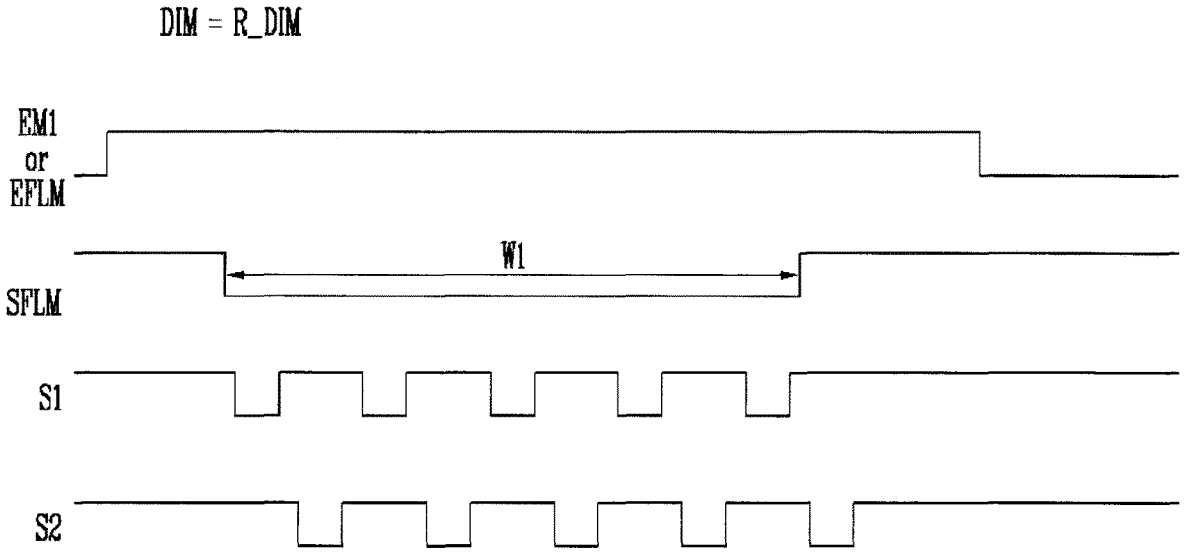
FIGS. 10A to 10C are waveform diagrams showing examples of an operation of the display device of FIG. 1 based on a dimming level according to some example embodiments of the present invention.
Figure 10B:
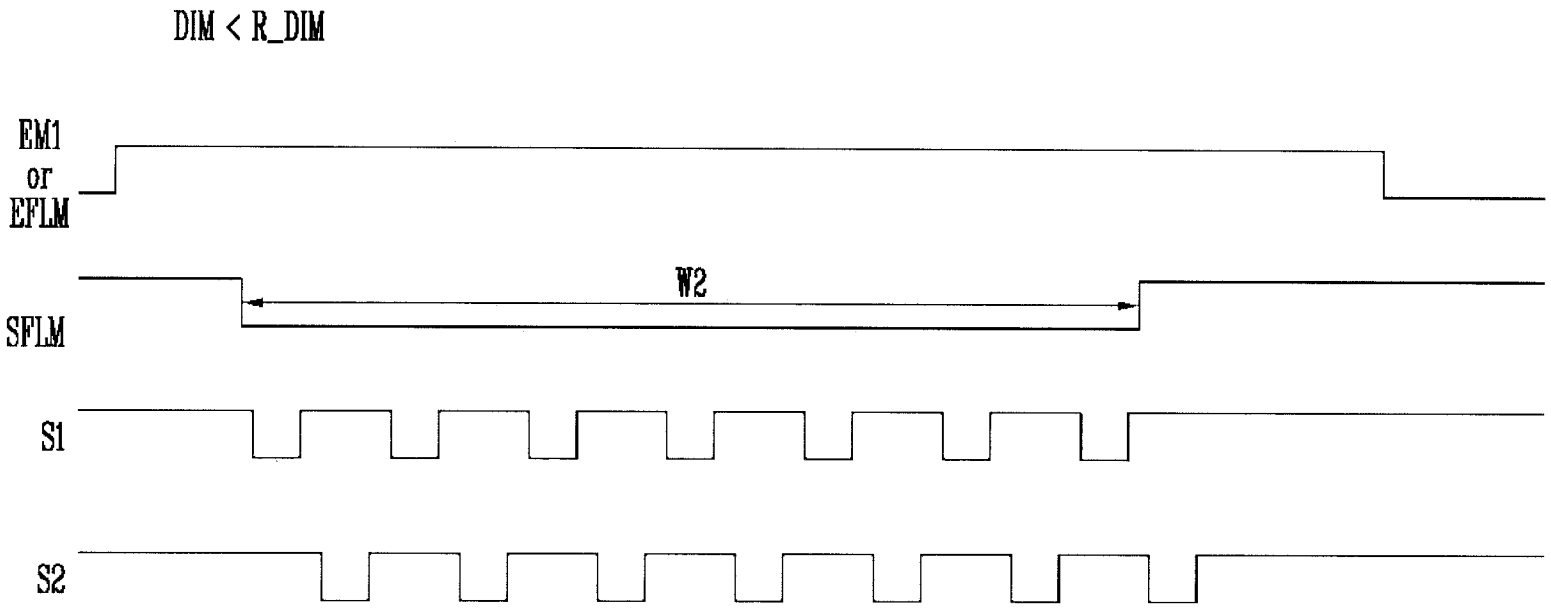
Figure 10C:
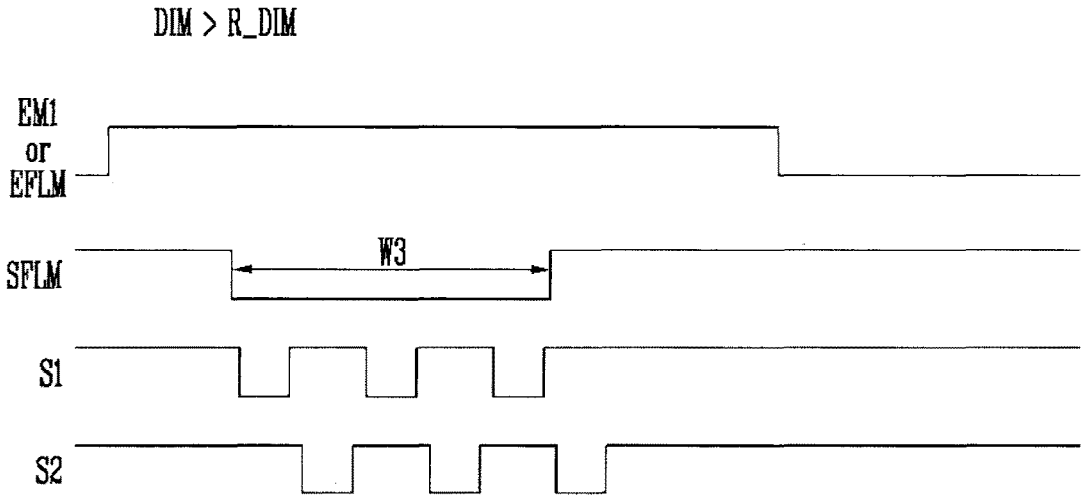

FIGS. 10A to 10C are waveform diagrams showing another examples of an operation of the display device of FIG. 1 based on a dimming level according to the embodiments of the present invention.

In FIGS. 10A to 10C, the same reference numerals are used for the same elements as those described referring to FIGS. 6A to 6D, and a duplicate description will be omitted.

Referring to FIGS. 10A to 10C, the timing controller 500 may control the emission control start signal EFLM and the scan start signal SFLM according to on the dimming level DIM.

In some example embodiments, the timing controller 500 may control the width of the scan start signal SFLM (i.e., the width of the gate-on period of the scan start signal SFLM) in the non-emission period based on the dimming level DIM. The number of scan signals supplied to the scan lines SL1 to SLn may change based on the width of the scan start signal SFLM.

When the dimming level DIM corresponds to the reference dimming level R_DIM, the gate-off period of the emission control start signal EFLM has the first width. When the dimming level DIM is lower than the reference dimming level R_DIM, the width of the gate-off period of the emission control start signal EFLM increases to a predetermined width as the dimming level DIM decreases. When the dimming level DIM is higher than the reference dimming level R_DIM, the width of the gate-off period of the emission control start signal EFLM has the second width smaller than the first width regardless of the dimming level DIM.

As shown in FIG. 10A, when the current dimming level DIM corresponds to the predetermined reference dimming level R_DIM, the scan start signal SFLM may have the first width W1. For example, five first scan signals S1 may be output in response to the scan start signal SFLM. In this case, the data signal corresponding to the first horizontal line may be output from the data driver 400 in synchronization with the last scan signal of the first scan signal S1.

Therefore, the number of initialization of the on-bias state for the driving transistor of the pixel may increase, and the hysteresis of the driving transistor may be eliminated or reduced.

As shown in FIG. 10B, when the dimming level DIM is included in the first dimming period lower than the reference dimming level R_DIM, the scan start signal SFLM may have a second width W2 larger than the first width W1. Therefore, the number of scan signals supplied to one scan line in the first dimming period is larger than the number of scan signals at the reference dimming level R_DIM. For example, seven first scan signals S1 may be output corresponding to the scan start signal SFLM at a predetermined dimming level DIM included in the first dimming period. In some example embodiments, in the first dimming period, the width of the scan start signal SFLM may increase as the dimming level DIM becomes lower. That is, as the dimming level DIM becomes lower, the number of scan signals supplied to each of the output scan lines may increase. Therefore, the hysteresis of the driving transistor is removed, and display defects such as a color drag and an afterimage at a low-luminance may be reduced.

As shown in FIG. 10C, when the dimming level DIM is included in the second dimming period higher than the reference dimming level R_DIM, the scan start signal SFLM may have the third width W3 smaller than the first width W1. In the case of a high-luminance emission, the number of scan signals supplied to each of scan lines is reduced because a color drag due to a grayscale change is relatively not observed.

As described above, by increasing the width of the scan start signal in a low-luminance region below the reference dimming level R_DIM referring to the dimming level, the number of scan signals supplied to each of scan lines may increase. As a result, the number of on-bias of the driving transistor in the low-luminance region increases, so that the display defects due to the hysteresis and the emission delay may be reduced.

Figure 11A:
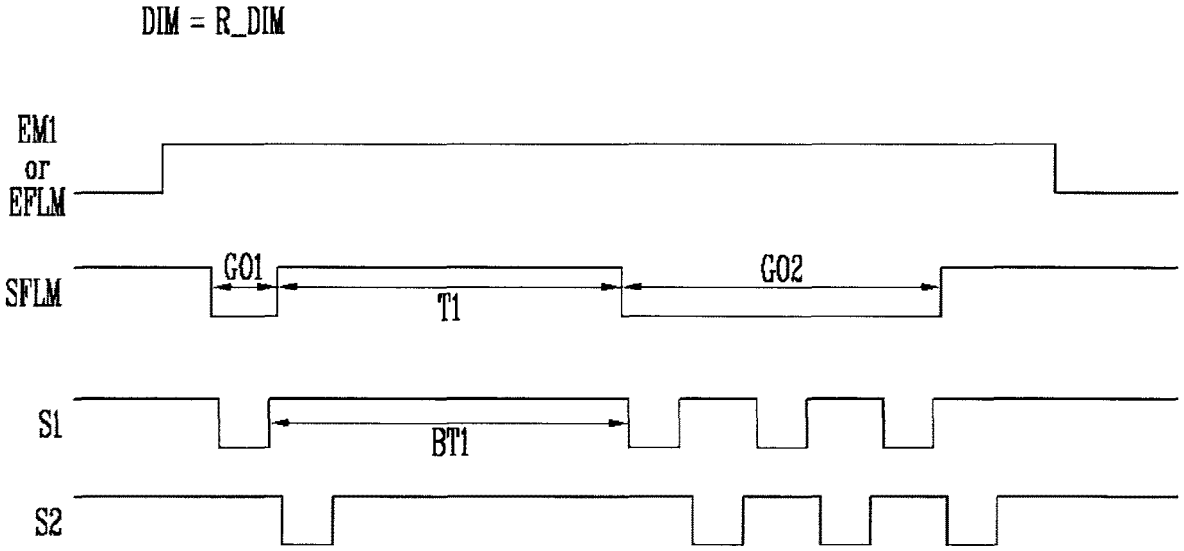
FIGS. 11A to 11C are waveform diagrams showing examples of an operation of the display device of FIG. 1 based on a dimming level according to some example embodiments of the present invention.
Figure 11B:
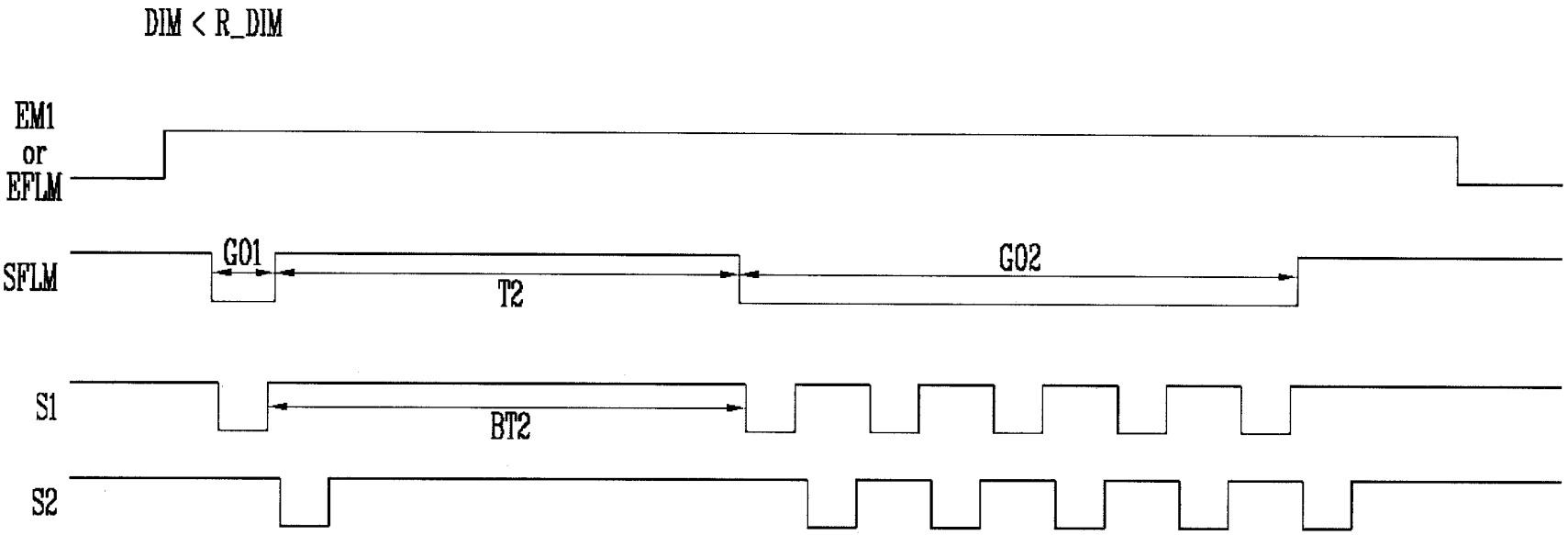
Figure 11C:
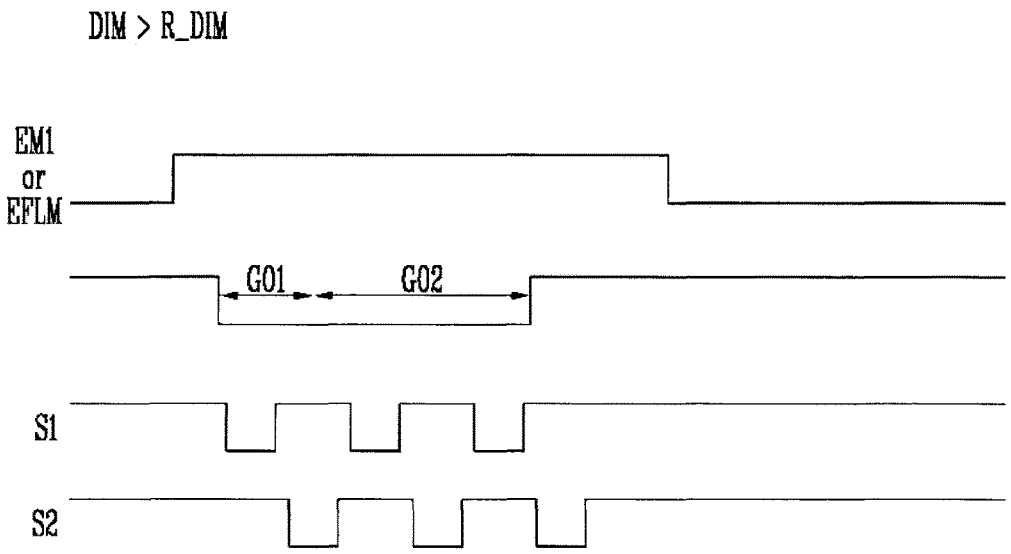

FIGS. 11A to 11C are waveform diagrams showing another examples of an operation of the display device of FIG. 1 based on a dimming level according to the embodiments of the present invention.

In FIGS. 11A to 11C, the same reference numerals are used for the same elements as those described referring to FIGS. 6A to 6D, and a duplicate description will be omitted.

Referring to FIGS. 11A to 11C, the timing controller 500 may control the emission control start signal EFLM and the scan start signal SFLM according to the dimming level DIM.

In some example embodiments, the timing controller 500 may control the width of the gate-on periods GO1 and GO2 and the intervals T1 and T2 between the gate-on periods GO1 and GO2 of the scan start signal SFLM according to the dimming level DIM.

For example, as shown in FIG. 11A, when the dimming level DIM corresponds to the reference dimming level R_DIM, the first gate-on period GO1 of the scan start signal SFLM may overlap one scan signal S1 of the first scan line S1, the second gate-on period GO2 may overlap three scan signals of the first scan line, and the interval between the first gate-on period GO1 and the second gate-on period GO2 may be the first interval T1.

Meanwhile, as shown in FIG. 11B, when the dimming level DIM is lower than the reference dimming level R_DIM, the first gate-on period GO1 of the scan start signal SFLM may overlap one scan signal S1 of the first scan line, the second gate-on period GO2 may overlap five scan signals of the first scan line, and the interval between the first gate-on period GO1 and the second gate-on period GO2 may be the second interval T2 larger than the first interval T1.

As described above, as the dimming level DIM decreases, the number of scan signals supplied to each of scan lines and the interval between gate-on periods increase, so that poor visibility due to an abrupt gradation change in a low-luminance may be improved.

Further, as shown in FIG. 11C, in the case of a medium luminance or more in which the dimming level DIM is higher than the reference dimming level R_DIM, the first gate-on period GO1 and the second gate-on period GO2 of the scan start signal SFLM may be continuous, and the total width W3 of the scan start signal SFLM may also be set to be smaller than the sum of the gate-on periods at the reference dimming level R_DIM.

Figure 12A:
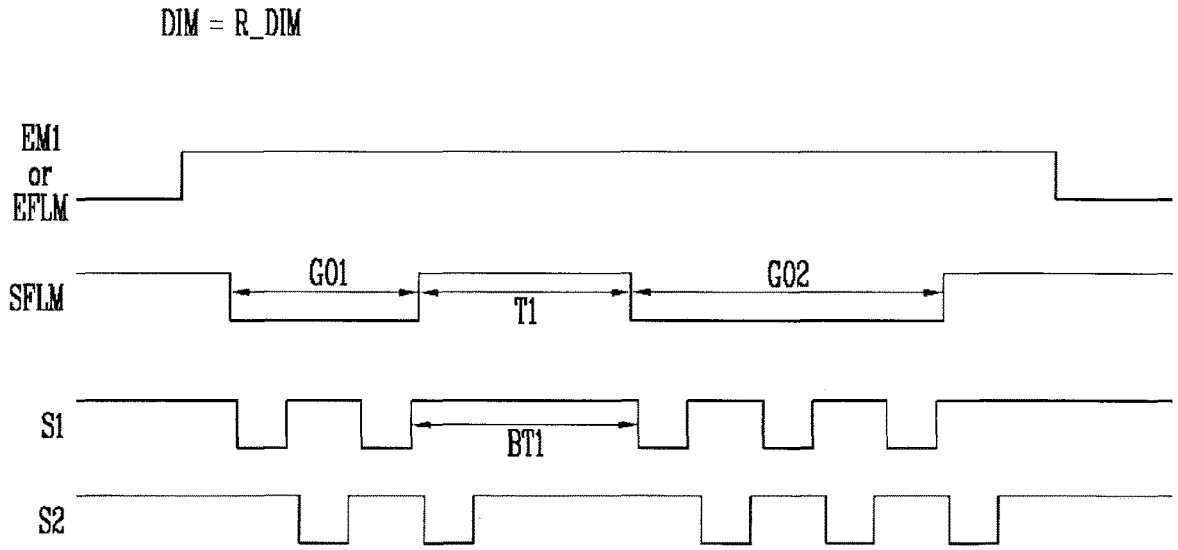
FIGS. 12A and 12B are waveform diagrams showing another example of an operation of the display device of FIG. 1 based on a dimming level.
Figure 12B:
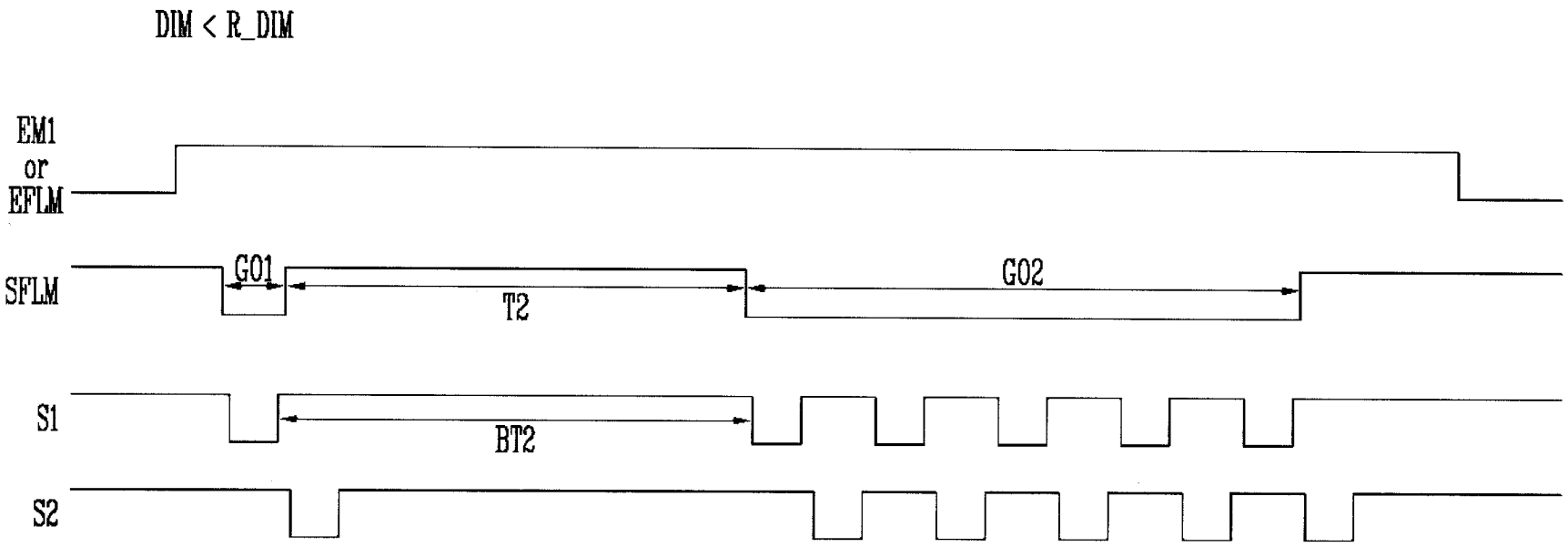

FIGS. 12A and 12B are waveform diagrams showing another example of an operation of the display device of FIG. 1 based on a dimming level.

In FIGS. 12A and 12B, the same reference numerals are used for the same elements as those described referring to FIGS. 11A to 11B, and a duplicate description will be omitted.

Referring to FIGS. 12A and 12B, below the reference dimming level R_DIM, the widths of the gate-on periods GO1 and GO2 of the scan start signal SFLM and the intervals T1 and T2 between the gate-on periods GO1 and GO2 may be controlled.

For example, as the dimming level DIM decreases, the width of the first gate-on period GO1 may decrease while the width of the second gate-on period GO2 may increase. In addition, as the dimming level DIM decreases, the intervals T1 and T2 between the first gate-on period GO1 and the second gate-on period GO2 may increase.

The initialization of the on-bias state in each horizontal line may be performed differently in response to the first gate-on period GO1 of the scan start signal SFLM according to the dimming level DIM. For example, as shown in FIG. 12A, in the reference dimming level R_DIM, two scan signals may be output corresponding to the first gate-on period GO1, and as shown in FIG. 12B, when the dimming level R_DIM is lower than the reference dimming level R_DIM, one scan signal may be output corresponding to the first gate-on period GO1.

In addition, as shown in FIGS. 12A and 12B, the bias holding time BT1 in each horizontal line may be applied differentially in response to the first gate-on period GO1 and the second gate-on period GO2 of the scan start signal SFLM according to the dimming level DIM.

As described above, the display device 1000 according to some example embodiments of the present invention and timing controller 500 included therein may increase at least one of the interval between the gate-on periods and the width of the gate-on period of the scan start signal as the dimming level DIM becomes lower. Therefore, the number and a supplying interval of scan signals supplied to the pixels during the non-emission period may be controlled based on the dimming level DIM, the hysteresis of the driving transistor included in the pixel is eliminated, and the emission delay of a specific pixel may be reduced.

Figure 13:
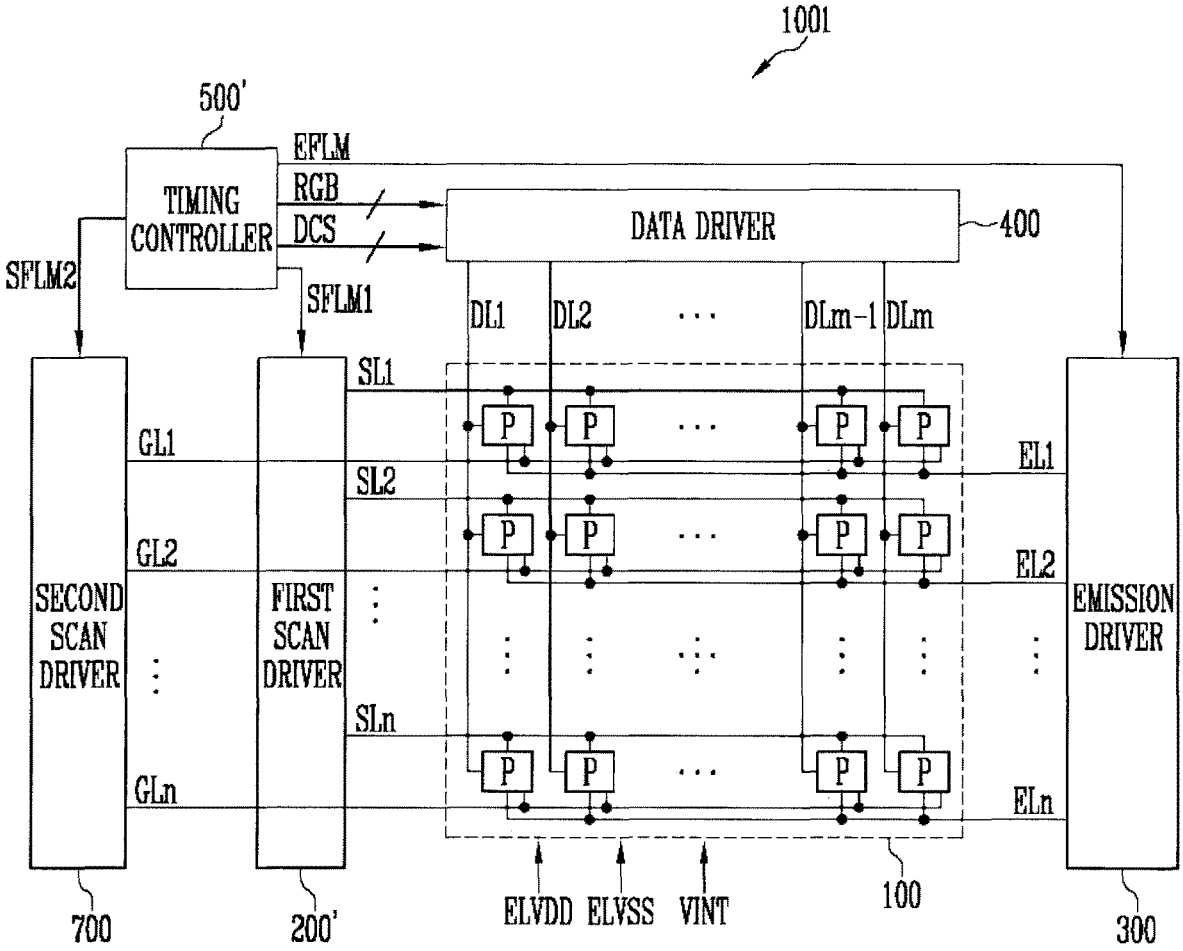
FIG. 13 is a block diagram showing a display device according to some example embodiments of the present invention.

FIG. 13 is a block diagram showing a display device according to some example embodiments of the present invention.

Because the display device 1001 of FIG. 13 is the same as the display device of FIG. 1 except for a configuration of the scan drivers, like reference numerals are used for like or corresponding elements, and a duplicate description thereof will be omitted.

Referring to FIGS. 2A and 13, the display device 1001 may include a display panel 100, a first scan driver 200', a second scan driver 700, an emission driver 300, a data driver 400, and a timing controller 500'.

The first scan driver 200' and the second scan driver 700 may generate a scan signal corresponding to the i-1-th scan line and a scan signal corresponding to the i-th scan line of the pixel P of FIG. 2A based on the first scan start signal SFLM1 and the second scan start signal SFLM2, respectively. For example, the scan signal output from the first scan driver 200' may be supplied to the fourth transistor T4 of each pixel through the first scan lines SL1 to SLn, and the scan signal output from the second scan driver 700 may be supplied to the second, third and seventh transistors T2, T3 and T7 of each pixel through the second scan lines GL1 to GLn. Therefore, the first scan driver 200' may control an on-bias state of the driving transistor of the pixel, and the second scan driver 700 may control an off-bias state of the driving transistor of the pixel.

Because an operation of each of the first scan driver 200' and the second scan driver 700 is the same as that described above, a detailed description thereof will be omitted.

Figure 14:
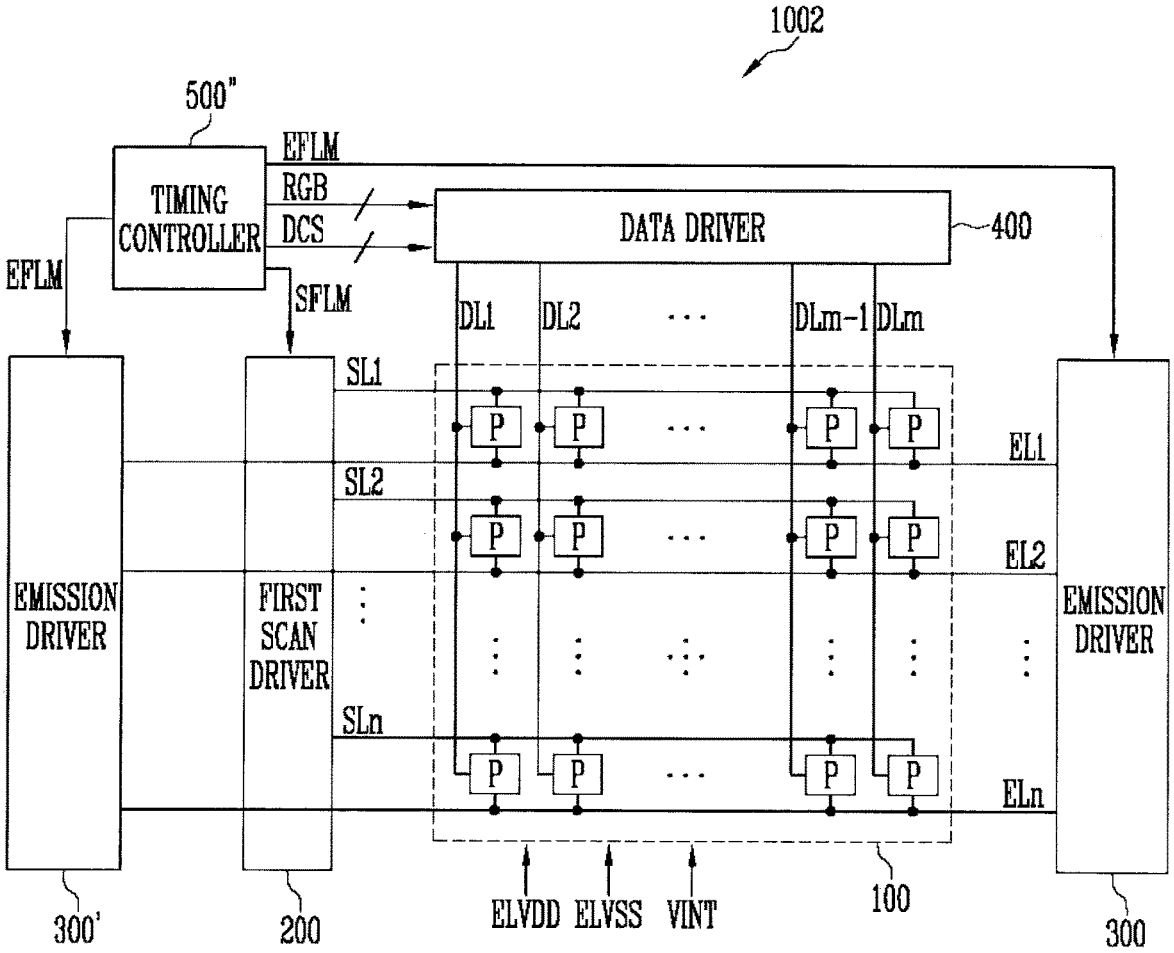
FIG. 14 is a block diagram showing a display device according to some example embodiments of the present invention.

FIG. 14 is a block diagram showing a display device according to some example embodiments of the present invention.

Because the display device 1002 of FIG. 14 is the same as the display device of FIG. 1 except for a configuration of the emission drivers, like reference numerals are used for like or corresponding elements, and redundant explanations are omitted.

Referring to FIG. 14, the display device 1002 may include a display panel 100, a scan driver 200, a first emission driver 300, a second emission driver 300', a data driver 400, and a timing controller 500".

In the display device 1002, the first emission driver 300 and the second emission driver 300' may be arranged at both sides of the display panel 100. Because an operation of each of the first emission driver 300 and the second emission driver 300' is the same as that described above, a detailed description thereof will be omitted.

As described above, the display devices 1000, 1001 and 1002 according to some example embodiments of the present invention may reduce display defects such as a color drag and an afterimage due to an abrupt gradation change at low-luminance by controlling the number and supplying interval of scan signals supplied to the pixel during the non-emission period and the scan signal application intervals based on the dimming level DIM.

The display device according to some example embodiments of the present invention may be applied to various electronic devices. For example, the display device may be applied to an HMD device, a TV, a digital TV, a 3D TV, a PC, a home electronic device, a notebook computer, a tablet computer, a mobile phone, a smart phone, a PDA, a PMP, a digital camera, a music player, a portable game console, a navigation device, a wearable device, and the like.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

While the present invention has been shown and described with reference to certain example embodiments thereof, it will be understood by those skilled in the art that various changes in forms and details may be made therein without departing from the spirit and scope of the present invention as defined by the appended claims and their equivalents.

What is claimed is:

1. A display device comprising:

a display panel including a plurality of pixels;

a scan driver configured to supply a scan signal to the plurality of pixels through a plurality of scan lines based on a scan start signal;

an emission driver configured to supply an emission control signal to the plurality of pixels through a plurality of emission control lines based on an emission control start signal; and a timing controller configured to control an interval between a plurality of gate-on periods of the scan start signal within a gate-off period of the emission control start signal based on a dimming level, and wherein the scan driver is configured to supply the scan signal to each of the plurality of scan lines a plurality of times in response to the gate-on periods of the scan start signal within a non-emission period defined by a gate-off period of the emission control signal in one frame period.

2. The display device of claim 1, wherein the gate-on periods include a first gate-on period and a second gate-on period, and wherein an interval between the first gate-on period and the second gate-on period is a first interval when the dimming level corresponds to a predetermined reference dimming level.

3. The display device of claim 2, wherein the interval between the first gate-on period and the second gate-on period is a second interval larger than the first interval when the dimming level is lower than the predetermined reference dimming level.

4. The display device of claim 2, wherein the interval between the first gate-on period and the second gate-on period increases as the dimming level decreases in a first dimming period of which the dimming level is lower than the predetermined reference dimming level.

5. The display device of claim 2, wherein the first gate-on period and the second gate-on period are continuous with each other in a second dimming period of which the dimming level is higher than the predetermined reference dimming level.

6. The display device of claim 2, wherein the interval between the first gate-on period and the second gate-on period is a second interval smaller than the first interval in a second dimming period of which the dimming level is higher than the predetermined reference dimming level.

7. The display device of claim 2, wherein a width of the first gate-on period and a width of the second gate-on period are constant regardless of the dimming level.

8. The display device of claim 2, wherein a width of at least one of the first gate-on period or the second gate-on period increases based on a predetermined dimming level as the dimming level decreases.

9. The display device of claim 1, wherein the gate-on periods include a first gate-on period and a second gate-on period, the scan driver is configured to supply j (j is a positive integer) scan signals to each of the scan lines in response to the first gate-on period of the scan start signal, and the scan driver is configured to supply k (k is an integer of 2 or more) scan signals to each of the scan lines in response to the second gate-on period of the scan start signal.

10. The display device of claim 9, wherein a number of scan signals supplied to each of the scan lines increases as a width of the second gate-on period increases.

11. The display device of claim 1, wherein the timing controller is configured to control a width of the gate-off period of the emission control start signal supplied to the emission driver based on the dimming level.

12. The display device of claim 1, wherein a width of the gate-off period of the emission control start signal is a first off-width when the dimming level corresponds to a predetermined reference dimming level, the width of the gate-off period of the emission control start signal increases as the dimming level decreases when the dimming level is lower than the predetermined reference dimming level, and the width of the gate-off period of the emission control start signal is a second off-width smaller than the first off-width regardless of the dimming level when the dimming level is higher than the predetermined reference dimming level.

13. The display device of claim 1, wherein the timing controller comprises:

a first start signal determiner configured to determine a width of the gate-off period of the emission control start signal based on a dimming signal including information of the dimming level; and a second start signal determiner configured to determine an interval between a first gate-on period and a second gate-on period of the scan start signal based on at least one of the dimming signal and the width of the gate-off period of the emission control start signal.

14. The display device of claim 1, further comprising:

a data driver configured to supply a data signal to a plurality of data lines so as to be synchronized with a last scan signal of each of the plurality of scan lines among scan signals supplied to each of the plurality of scan lines.

15. The display device of claim 1, wherein the scan driver is configured to control an interval between a scan signal output in response to a first gate-on period and a scan signal output in response to a second gate-on period according to an interval between the first gate-on period and the second gate-on period of the scan start signal.

16. A display device comprising:

a display panel including a plurality of pixels;

a scan driver configured to supply a scan signal to the plurality of pixels through a plurality of scan lines based on a scan start signal;

an emission driver configured to supply an emission control signal to the plurality of pixels through a plurality of emission control lines based on an emission control start signal; and a timing controller configured to control a width of the scan start signal in a gate-off period of the emission control start signal defining a non-emission period of one frame based on a dimming level, and wherein the timing controller is configured to control a width of the gate-off period of the emission control start signal supplied to the emission driver based on the dimming level.

17. The display device of claim 16, wherein the scan start signal has a first width when the dimming level corresponds to a predetermined reference dimming level.

18. The display device of claim 17, wherein the scan start signal has a second width larger than the first width when the dimming level is lower than the predetermined reference dimming level.

19. The display device of claim 17, wherein a width of the scan start signal increases as the dimming level decreases when the dimming level is included in a first dimming period lower than the predetermined reference dimming level.

20. The display device of claim 19, wherein the scan start signal has a second width smaller than the first width when the dimming level is included in a second dimming period higher than the predetermined reference dimming level.

21. The display device of claim 20, wherein the scan start signal has a constant second width regardless of a change in the dimming level in the second dimming period.

22. The display device of claim 16, wherein the scan driver is configured to supply k (k is an integer of 2 or more) scan signals to each of the scan lines based on the width of the scan start signal.

23. The display device of claim 16, wherein the timing controller comprises:

a first start signal determiner configured to control a width of the gate-off period of the emission control start signal based on a dimming signal including information of the dimming level; and a second start signal determiner configured to control the width of a gate-on period of the scan start signal based on the dimming signal and the width of the gate-off period of the emission control start signal.

24. A timing controller comprising:

a first start signal determiner configured to determine a width of a gate-off period of an emission control start signal based on a dimming signal including information of a dimming level at which a display device emits light; and a second start signal determiner configured to determine at least one interval between a gate-on period of a scan start signal and at least one width of a gate-on period of the scan start signal based on the dimming signal.

25. The timing controller of claim 24, wherein the gate-on period includes a first gate-on period and a second gate-on period, and when the dimming level corresponds to a predetermined reference dimming level, an interval between the first gate-on period and the second gate-on period is a first interval.

26. The timing controller of claim 25, wherein the interval between the first gate-on period and the second gate-on period increases as the dimming level decreases in a first dimming period of which the dimming level is lower than the predetermined reference dimming level.

27. The timing controller of claim 25, wherein the first gate-on period and the second gate-on period are continuous with each other in a second dimming period of which the dimming level is higher than the predetermined reference dimming level.

28. The timing controller of claim 24, wherein the scan start signal has a first width when the dimming level corresponds to a predetermined reference dimming level.

29. The timing controller of claim 28, wherein a width of the scan start signal increases as the dimming level decreases when the dimming level is included in a first dimming period lower than the predetermined reference dimming level.

30. The timing controller of claim 28, wherein the scan start signal has a constant second width smaller than the first width regardless of a change in the dimming level when the dimming level is included in a second dimming period higher than the predetermined reference dimming level.

* * * * *